US010467994B2

(12) United States Patent
Jackson

(10) Patent No.: US 10,467,994 B2
(45) Date of Patent: Nov. 5, 2019

(54) STRING PULLING MECHANISMS FOR STRINGED MUSICAL INSTRUMENTS AND RELATED METHODS

(71) Applicant: David Jackson, Dahlonega, GA (US)

(72) Inventor: David Jackson, Dahlonega, GA (US)

( * ) Notice: Subject to any disclaimer, the term of this patent is extended or adjusted under 35 U.S.C. 154(b) by 0 days.

(21) Appl. No.: 15/875,877

(22) Filed: Jan. 19, 2018

(65) Prior Publication Data

US 2019/0019478 A1 Jan. 17, 2019

Related U.S. Application Data

(63) Continuation of application No. 15/646,662, filed on Jul. 11, 2017, now abandoned.

(51) Int. Cl.
*G10D 3/14* (2006.01)

(52) U.S. Cl.
CPC ..... *G10D 3/14* (2013.01); *G10D 3/143* (2013.01)

(58) Field of Classification Search
CPC ..... G10D 3/14
USPC ..... 84/312 R
See application file for complete search history.

(56) References Cited

U.S. PATENT DOCUMENTS 3,299,762 A * 1/1967 Glass ..... G10F 1/06 84/95.1
3,427,916 A * 2/1969 Fender ..... G10D 1/085 84/267
3,437,001 A * 4/1969 Kraft ..... G10D 3/146 84/312 R
3,686,993 A * 8/1972 Fender ..... G10D 3/143 257/720
4,044,645 A * 8/1977 Franzmann ..... G10D 3/143 84/313
4,170,161 A * 10/1979 Kaftan ..... G10D 3/143 84/297 R
4,191,086 A * 3/1980 Spercel ..... G10D 3/14 84/306
4,408,515 A * 10/1983 Sciuto ..... G10D 3/14 84/267
4,515,059 A * 5/1985 Siminoff ..... G10D 3/14 84/306
4,549,461 A * 10/1985 Rose ..... G10D 3/04 84/267
4,643,069 A * 2/1987 Borisoff ..... G10D 3/14 84/306
5,456,151 A * 10/1995 Enserink ..... G10D 3/12 84/297 R
5,497,690 A * 3/1996 Soupios ..... G10D 3/04 84/294

(Continued)

*Primary Examiner* — David S Warren
*Assistant Examiner* — Christina M Schreiber
(74) *Attorney, Agent, or Firm* — Buche & Associates, P.C.; John K. Buche; Bryce A. Johnson

(57) ABSTRACT

Disclosed are apparatus and related methods for adjusting the pitch of a string on a stringed instrument. In one embodiment, the disclosed devices enable a musician to adjust the tautness and, accordingly, the pitch of individual strings of a stringed instrument by simply pushing a lever or rotating a threaded piston or on or adjacent to the bridge of the guitar. The disclosed devices can preferably be outfitted on electric or acoustic stringed instruments, including guitars. The more specific aspects of the preferred embodiments are discussed in greater detail with reference to the figures.

20 Claims, 16 Drawing Sheets

(56) References Cited

U.S. PATENT DOCUMENTS

| | | | | |
|---|---|---|---|---|
| 7,183,475 | B2 * | 2/2007 | Van Halen | G10D 3/12 84/297 R |
| 7,488,880 | B2 * | 2/2009 | Batio | G10D 3/046 84/267 |
| 7,935,876 | B1 * | 5/2011 | West | G10D 3/146 84/200 |
| 8,796,524 | B1 * | 8/2014 | Deck | G10D 3/146 84/313 |
| D730,435 | S * | 5/2015 | Turner | D17/20 |
| 9,076,412 | B1 * | 7/2015 | Rolling | G10D 3/146 |
| 9,847,076 | B1 * | 12/2017 | McCabe | G10D 3/146 |
| 9,934,762 | B1 * | 4/2018 | Jackson | G10D 3/06 |
| 2012/0318117 | A1 * | 12/2012 | Deck | G10D 3/146 84/313 |
| 2016/0019871 | A1 * | 1/2016 | Jackson | G10D 3/143 84/312 P |
| 2016/0189691 | A1 * | 6/2016 | Hackett | G10D 1/08 84/298 |
| 2016/0260420 | A1 * | 9/2016 | Jackson | G10D 3/14 |
| 2017/0193973 | A1 * | 7/2017 | Middleton | F16H 1/16 |
| 2019/0019478 | A1 * | 1/2019 | Jackson | G10D 3/14 |

* cited by examiner

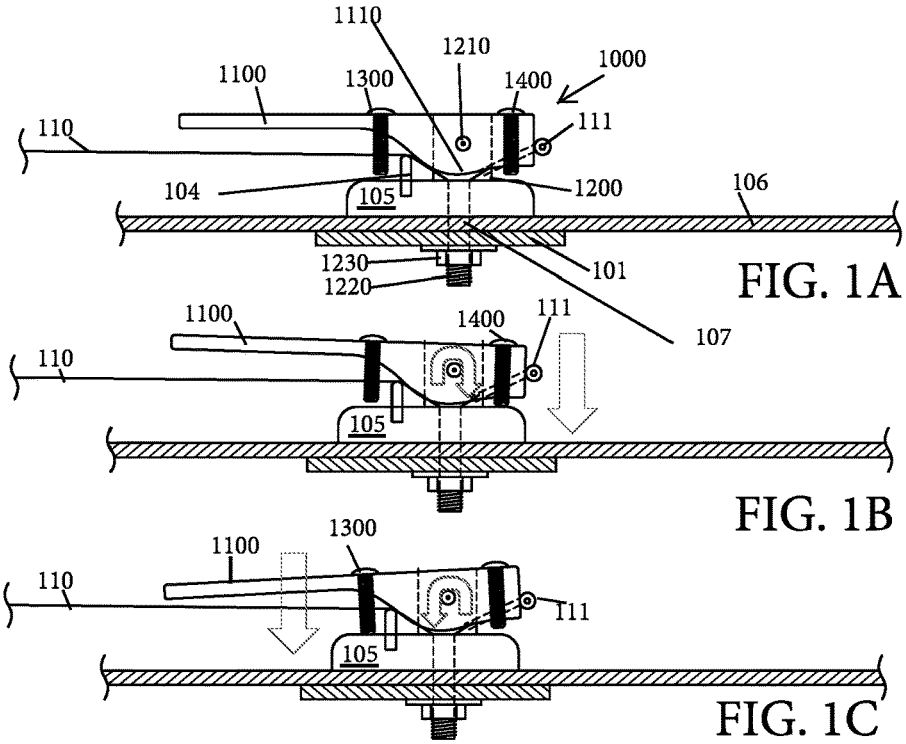
FIG. 1A
FIG. 1B
FIG. 1C
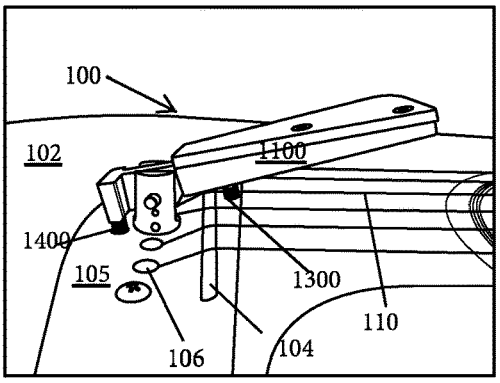
FIG. 2
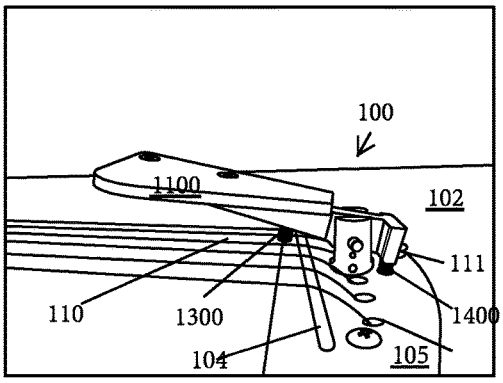
FIG. 3
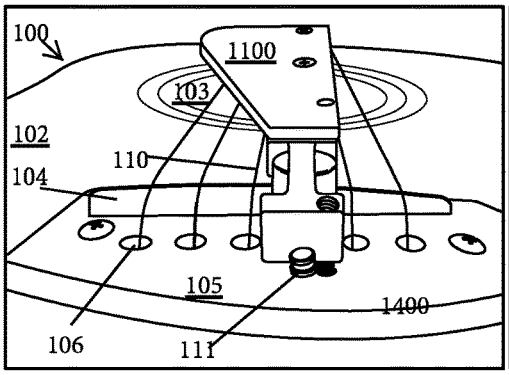
FIG. 4
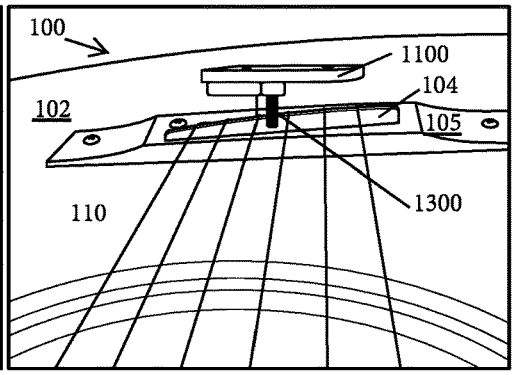
FIG. 5

STRING PULLING MECHANISMS FOR STRINGED MUSICAL INSTRUMENTS AND RELATED METHODS

CROSS-REFERENCE TO RELATED APPLICATIONS

This application claims the benefit of application Ser. No. 15/646,662 (filed on Jan. 11, 2017) titled "Improvements to string pulling mechanisms for stringed musical and related methods."

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

REFERENCE TO AN APPENDIX SUBMITTED ON A COMPACT DISC AND INCORPORATED BY REFERENCE OF THE MATERIAL ON THE COMPACT DISC

Not applicable.

STATEMENT REGARDING PRIOR DISCLOSURES BY THE INVENTOR OR A JOINT INVENTOR

Reserved for a later date, if necessary.

BACKGROUND OF THE INVENTION

Field of Invention

The subject matter of this document is related to string pulling or other tension manipulating devices for strings of a stringed musical instrument.

Background of the Invention

Stringed instruments, e.g. guitars, make sounds via string vibrations. Every sound from a vibrating string has a perceptual property called pitch, which is a qualitative and quantitative measure of a listener's perception of the frequency of string vibration. A vibrating string's pitch depends on many things, including the string's thickness, tension strength, and length. Musicians can create a range of sound pitch via varying such physical characteristics of their strings.

Guitars and other stringed instruments typically have a preset pitch range that is established by pulling taut a string and setting the taut between the furthest end (key head) of a guitar's neck and the guitar's bridge. In most guitars, the tautness of the strings and the strings' corresponding pitch range is predetermined. In order to manually change the predetermined pitch range on a typical guitar, the strings must be manually tuned, one-by-one. This manual tuning is usually too awkward and time consuming to be done during a performance and as a result, the performer is typically limited to single pitch range during the duration of the musical performance with any single instrument.

Pitch-changing mechanisms for stringed instruments are known. In the case of the well-known instrument called a "pedal steel guitar," the ability to mechanically change the pitch of a string by pressing a foot pedal or knee lever provides a wider range of pitches to musicians without tedious and time-consuming tuning. Pedaled pitch changing mechanisms are also known in piano type musical instruments. But, pedaled instruments are complicated, enlarge the footprint of a musical instrument, and require a musician to sit down or stand in a one place. Hand-operated pitch changing mechanisms are therefore preferable to foot-pedal controlled pitch changing mechanisms in some cases.

In view of the foregoing, a need exists for a pitch changing mechanism that transform a fixed-pitch guitar into an instrument with hand-activated pitch changing capabilities without destructive modifications. Thus, with the disclosed improvements described herein, existing guitars can be easily converted to a pitch-changing device and vice versa without professional installation.

SUMMARY OF THE INVENTION

In view of the foregoing, an object of this specification is to disclose apparatus and related methods for adjusting the pitch of a string on a stringed instrument. In one embodiment, the disclosed devices enable a musician to adjust the tautness and, accordingly, the pitch of individual strings of a stringed instrument by simply pushing a lever or rotating a threaded piston or on or adjacent to the bridge of the guitar. In other embodiments, the pitch of an individual string of a stringed instrument may be adjusted via cam action (such as "bolt action" on a rifle). The disclosed devices can preferably be outfitted on electric or acoustic stringed instruments, including guitars.

In one embodiment, the pitch changing device is set-up as a push lever and comprises: (1) a mounting mechanism that includes a fulcrum, a lever, a down stop screw, and an open tuning top screw or stop. In operation, the lever may be mechanically coupled to a string so that whenever the lever is engaged, tension on the string is increased so that the pitch is correspondingly raised. Suitably, the open tuning stop screw restricts movement of the lever in response to the tension of the string pulling on the lever, after engagement of the lever is relaxed, and while the down stop screw restricts movement of the lever to a certain degree when engaged. The amount of movement of the lever may be set so that fully engaging the lever or fully relaxing the lever moves the pitch of a string by a whole or half tone. Suitably, the mounting mechanism for adjusting the tautness and pitch of a string of a stringed musical instrument may be easily installed on or adjacent to the bridge of a guitar.

In another embodiment, the pitch changing device is set-up as a rotary lever and comprises: a mounting mechanism that includes flat head screw that couples to a threaded bushing inside the cavity of a stringed instrument. In operation, the string may be provided through the threaded female nut mechanism and then mechanically coupled to the threaded piston engaged with the threaded nut. Suitably, when the piston is rotated relative to the nut, tension on the string is increased so that the pitch is correspondingly raised. Suitably, the interaction of the threads of the piston and nut restrict rotation of the piston in response to the tension of the string pulling on the piston, after engagement of the piston is relaxed, and while a down stop screw restricts rotation of the piston to a certain degree when engaged. The amount of movement of the piston may be set so that fully engaging the piston or fully relaxing the lever moves the pitch of a string by a whole or half tone. Suitably, the mounting mechanism for adjusting the tautness and pitch of a string of a stringed musical instrument may be easily installed on or adjacent to the bridge of a guitar.

In yet another embodiment, the pitch changing device may be set-up as a double rotary lever (i.e., more than one rotary lever), a combination rotary and push lever (i.e., more than one of each type of lever), a double push lever (i.e., more than one push lever). In either embodiment, the double levers may be each separately installed for changing the pitch of a single string or each installed on a one side of a split shaft or two shafts so that each of the double levers control the pitch of several strings at once. Suitably, the mounting mechanism for adjusting the tautness and pitch of a string of a stringed musical instrument may be easily installed on or adjacent to the bridge of a guitar.

In some cases a roller pin or knurl screw pin maybe used in lieu of traditional guitar pins to secure strings of a guitar adjacent to the bridge. Typically, the roller pin or knurl screws can be inserted through the guitar's pin hole and secured with a flat head screw and bushing inside the guitar cavity. In practice, the roller pin or knurl screw pin may operate to (a) provide additional down pressure on a string to prevent string buzz, (b) enable seamless string replacement without removal of the roller pin or knurls screw pin, and (c) eliminate or substantially reduce the need for "bridge lifting" (i.e., the effect of the bridge being pulled off the body by the tension of the strings).

BRIEF DESCRIPTION OF THE SEVERAL VIEWS OF THE DRAWINGS

Other objectives of the disclosure will become apparent to those skilled in the art once the invention has been shown and described. The manner in which these objectives and other desirable characteristics can be obtained is explained in the following description and attached figures in which:

FIG. 1A shows a first embodiment of a lever-type pitch adjustment mechanism 1000 for an acoustic guitar 100 coupled to a slack guitar string 110;

FIG. 1B shows a first embodiment of a lever-type pitch adjustment mechanism 1000 for an acoustic guitar 100 coupled to a taut but relaxed guitar string 110;

FIG. 1C shows a first embodiment of a lever-type pitch adjustment mechanism 1000 for an acoustic guitar 100 coupled to a taut and pulled guitar string 110;

FIG. 2 is a side view of the pitch adjustment mechanism 1000 of FIG. 1 for an acoustic guitar 100;

FIG. 3 is another side view of the pitch adjustment mechanism 1000 of FIGS. 1 and 2;

FIG. 4 is a rear view of the pitch adjustment mechanism 1000 of FIGS. 1 through 3;

FIG. 5 is a front view of the pitch adjustment mechanism 1000 of FIGS. 1 through 4;

Figure 6:
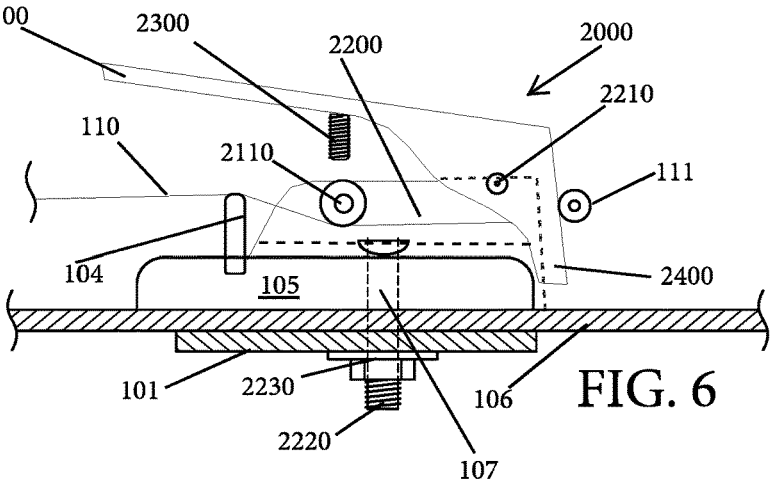
FIG. 6 shows a second embodiment of a lever-type pitch adjustment mechanism 2000 for an acoustic guitar 100 coupled to a taut but relaxed guitar string 110.

In the figures the following reference numerals identify the corresponding components:

100—acoustic guitar;
101—bridge mounting plate;
102—soundboard or topboard;
103—sound hole;
104—saddle;
105—bridge;
106—bridge pin;

107—bridge pin slot;
110—string;
111—ball-end;
200—electric guitar;
202—topboard;
204—bridge and saddle;
205—tail piece;
206—pickup
210—string;
211—ball-end;
1000—pitch adjustment mechanism;
1100—lever arm;
1110—lever belly;
1200—base;
1210—fulcrum pin or pivot pin;
1220—mounting screw;
1230—mounting nut;
1300—down stop screw;
1400—open tuning stop screw;
2000—pitch adjustment mechanism;
2100—lever arm;
2110—roller;
2200—base;
2210—fulcrum pin or pivot pin;
2220—mounting screw;
2230—mounting nut;
2300—down stop screw;
2400—open tuning stop;
3000—pitch adjustment mechanism;
3100—lever arm;
3200—base;
3210—fulcrum pin or pivot pin;
3300—down stop screw;
3400—open tuning stop screw;
4000—pitch adjustment mechanism;
4100—lever arm;
4200—base;
4220—pulling screw;
4299—set screw;
4300—down stop screw;
4400—open tuning stop;
5000—pitch adjustment mechanism;
5100—lever arm;
5200—base;
5220—pulling screw;
5300—down stop screw;
5400—open tuning stop;
5500—roller housing;
5510—roller;
6000—pitch adjustment mechanism;
6100—lever arm;
6200—base;
6210—fulcrum or pivot;
6300—down stop screw;
6400—open tuning stop;
6500—pickup plate;
6510—roller;
6520—lip.
7000—pitch adjustment mechanism;
7100—lever arm;
7200—base;
7220—pulling screw;
7300—down stop screw;
7400—open tuning stop;

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Disclosed are apparatus and related methods for adjusting the pitch of a string on a stringed instrument. In one embodiment, the disclosed devices enable a musician to adjust the tautness and, accordingly, the pitch of individual strings of a stringed instrument by simply pushing a lever or rotating a threaded piston or on or adjacent to the bridge of the guitar. The disclosed devices can preferably be outfitted on electric or acoustic stringed instruments, including guitars. The more specific aspects of the preferred embodiments are discussed in greater detail with reference to the figures.

FIGS. 1A, 1B, and 1C show a cross-section of a first embodiment of a lever-type pitch adjustment mechanism 1000. As shown, the pitch adjustment mechanism 1000 may be defined by a lever arm 1100, a base 1200, a down stop screw 1300, and an open tuning stop screw 1400. Suitably, the lever arm 1100 is coupled to the base 1200 via a pivot or fulcrum pin 1210 through the belly 1110 of the lever arm 1100. In a preferred embodiment, the belly 1110 defines an arc and the pivot pin 1210 is provided coaxial to said arc. On one side of the pivot pin 1210, a down stop screw 1300 is provided through the lever arm 1100. On another side of the pivot pin 1210, an open tuning stop screw 1400 is provided through the lever arm 1100. As discussed in greater detail below, the pitch adjustment mechanism 1000 may be installed on an acoustic guitar 100 (not shown).

FIGS. 2, 3, 4, and 5 respectively show a right-side view, a left-side view, a rear view and a front view of the pitch adjustment mechanism 1000 installed on the bridge 105 of an acoustic guitar 100. As can be appreciated by those of skill in the art, the guitar 100 suitably features: a sound board or top board 102; a sound hole 103; a saddle 104; a bridge 105; and strings that are secured to the bridge 105 via either a bridge pin 106 or a ball end 111. In the depicted embodiment, the pitch changing mechanisms has replaced a bridge pin 106 and is coupled to a string with a ball end 111.

Referring to FIGS. 1A and 2 through 4, the pitch adjustment mechanism 1000 may be installed on the acoustic guitar 100 via (a) positioning the base 1200 over a bridge pin slot 107 of the bridge 105; (b) running a mounting screw 1220 of the base 1200 through the bridge pin slot 107 of the bridge 105, through the top plate 102 of the guitar 100, and through the bridge plate 101 on the underside of the top plate 102; and (c) securing a mounting nut 1230 to the exposed end of the mounting screw 1200. In the preferred embodiment, base 1200 is installed so that the pivot pin 1200 located behind the saddle 104 of the guitar, a first end of the lever arm 100 is provided over the saddle and strings 110 of the guitar, and a second end of the lever arm is provided behind the saddle 104. Suitably, a string 110 with a ball end 111 may be strung up on the guitar 100 so that the string 110 is pulled taut to the saddle 104, strung along the belly 1110 of the lever arm 1110 and, coupled to the back end of the lever arm 1000 via the ball end 111.

In use, the pitch adjustment mechanism 1000 may be used to adjust the pitch of a guitar string 110. This operation may be illustrated with reference to FIGS. 1A through 1C. FIG. 1A shows a first embodiment of the lever-type pitch adjustment mechanism 1000 for an acoustic guitar 100 coupled to a slack guitar string 110. As shown, the lever arm 1000 is coupled to the string 110 via the ball end 111 but the lever arm 110 is not biased in any direction around the pivot or fulcrum pin 1210 because the string 110 is slack. FIG. 1B shows pitch adjustment mechanism 1000 for an acoustic guitar 100 coupled to a taut but relaxed guitar string 110, wherein the tension in the string 110 is applied to the back end of the lever arm 1000 so that the back end of the lever arm 1000 is pulled toward the bridge 105. Suitably, the back end of the lever arm 1000 is run through by the open tuning stop screw 1400, which abuts the bridge 105 to keep the string from pulling the lever arm all the way around the pivot pin 1210. Suitably, the extent to which the open tuning stop screw is provided through the lever arm 1100 will determine the initial pitch of the string 110 since the configuration shown in FIG. 1B will be the default position whenever the string 110 is under tension. Referring now to FIG. 1C, the lever may be pulled by hand-action until the down stop screw 1300 abuts the bridge 105. Suitably, such action increases the tension in the string 110 by pulling the string 110 under the belly 1110 of the lever arm 1000. In a preferred embodiment the increased tension can modify the pitch of the string 110 up to a full tone. As can be appreciated, the amount of pitch adjustment attainable by pulling/pushing the lever 1100 can varied up to the limit set by the down stop screw's 1300 gridlocking interaction with the bridge 105. Suitably, relaxing the lever arm 1100 will cause the lever arm 1100 and string 110 to return to the configuration of FIG. 1B since the string tension will pull on the back end of the lever arm 1100 in the manner illustrated.

FIG. 6 shows a cross-section of a second embodiment of a lever-type pitch adjustment mechanism 2000. As shown, the pitch adjustment mechanism 2000 may be defined by a lever arm 2100, a roller 2110, a base 2200, a down stop screw 2300, and an open tuning stop 2400. Suitably, the lever arm 2100 is coupled to the base 2200 via a pivot or fulcrum pin 2210 through the lever arm 2100. In a preferred embodiment, the roller 2110 defines a rotating disc and the pivot pin 2210 is provided adjacent to said disc so that the roller and the lever arm rotate independently relative to the base. On one side of the pivot pin 2210, a down stop screw 2300 is provided through the lever arm 2100. On another side of the pivot pin 2210, an open tuning stop 2400 is provided on the distal end of the lever arm 2100. As discussed in greater detail below, the pitch adjustment mechanism 1000 may be installed on an acoustic guitar 100 (not shown).

Referring still to FIG. 6, the pitch adjustment mechanism 2000 may be installed on an acoustic guitar 100 via (a) positioning the base 2200 over a bridge pin slot 107 of the bridge 105; (b) running a mounting screw 2220 (e.g., flat head screw for string clearance) of the base 2200 through the bridge pin slot 107 of the bridge 105, through the top plate 102 of the guitar, and through the bridge plate 101 on the underside of the top plate 102; and (c) securing a mounting nut 2230 or threaded bushing (not shown) to the exposed end of the mounting screw 2220 on the inside of the guitar 100. In the preferred embodiment, the base 2200 is installed so that the pivot pin 2210 and roller 2110 are located behind the saddle 104 of the guitar, a first end of the lever arm 100 is provided over the saddle 104 and strings 110 of the guitar, and a second end of the lever arm is provided behind the saddle 104. Suitably, a string 110 with a ball end 111 may be strung up on the guitar so that the string 110 is pulled taut to the saddle 104, strung under the roller 2110, and coupled to the back end of the lever arm 1000 via the ball end 111.

In use, the pitch adjustment mechanism 2000 may be used to adjust the pitch of a guitar string 110. This operation may be illustrated with reference to FIG. 6. FIG. 6 shows a first embodiment of the lever-type pitch adjustment mechanism 2000 for an acoustic guitar coupled to a guitar string 110. As shown, the lever arm 2000 is coupled to the string 110 via the ball end 111. FIG. 6 shows the pitch adjustment mechanism 2000 coupled to a taut but relaxed guitar string 110, wherein the tension in the string 110 is applied to the back end of the lever arm 1000 so that the back end of the lever arm 1000 is pulled toward the bridge 105. Suitably, the back end of the lever arm 2000 is defined by the open tuning stop 2400, which abuts the base 2200 to keep the string 110 from pulling the lever arm 2100 all the way around the pivot pin 2210. Suitably, the open tuning stop screw 2400 will determine the initial pitch of the string 110 since the configuration shown in FIG. 1B will be the default position whenever the string 110 is under tension. As implied from the earlier figures (FIGS. 1A through 5), the lever 2100 may be pulled by hand-action until the down stop screw 2300 abuts the bridge 105. Suitably, such action increases the tension in the string 110 by pulling the string 100 over saddle 104 and under the roller 2110. Suitably, the roller can rotate as the string is pulled taut to reduce the wear-and-tear on the string 110. In a preferred embodiment the increased tension can modify the pitch of the string up to a full tone. As can be appreciated, the amount of pitch adjustment attainable by pulling/pushing the lever can varied up to the limit set by the down stop screw's 2300 gridlocking interaction with the bridge 105. Suitably, relaxing the lever arm 2000 will cause the lever arm 2000 and string 110 to return to the configuration of FIG. 6 since the string tension will pull on the back end of the lever arm 2000 in the manner illustrated.

Figure 7:
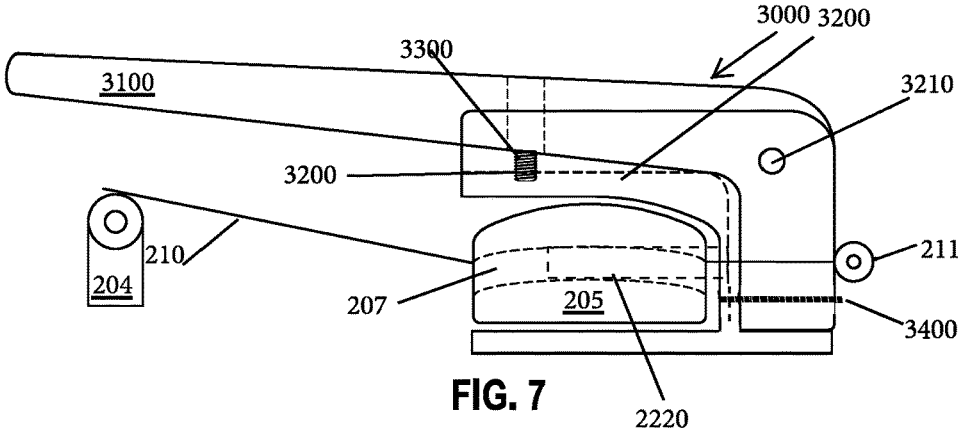
FIG. 7 shows a first embodiment of a lever-type pitch adjustment mechanism 3000 for an electric guitar 200 coupled to a taut but relaxed guitar string 210.

FIG. 7 shows a cross-section of a first embodiment of a lever-type pitch adjustment mechanism 3000 for an electric guitar 200. As shown, the pitch adjustment mechanism 3000 may be defined by a lever arm 3100, a base 3200, a down stop screw 3300, and an open tuning stop screw 3400. Suitably, the lever arm 3100 is coupled to the base 3200 via a pivot or fulcrum pin 3210. On one side of the pivot pin 3210, a down stop screw 3300 is provided through the lever arm 3100. On another side of the pivot pin 3210, an open tuning stop screw 3400 is provided through the lever arm 3100. As discussed in greater detail below, the pitch adjustment mechanism 3000 may be installed on an electric guitar 200 via securing the base 3200 to the tail piece 205 of the guitar 200 via a mounting screw 2220 provided into the string hole 207 of the tail piece 205, wherein the mounting screw 2220 is cannulated so that the string 210 can be provided therethrough to the lever 3100 and secured thereto via the ball end 211 of the string 210.

Figure 8:
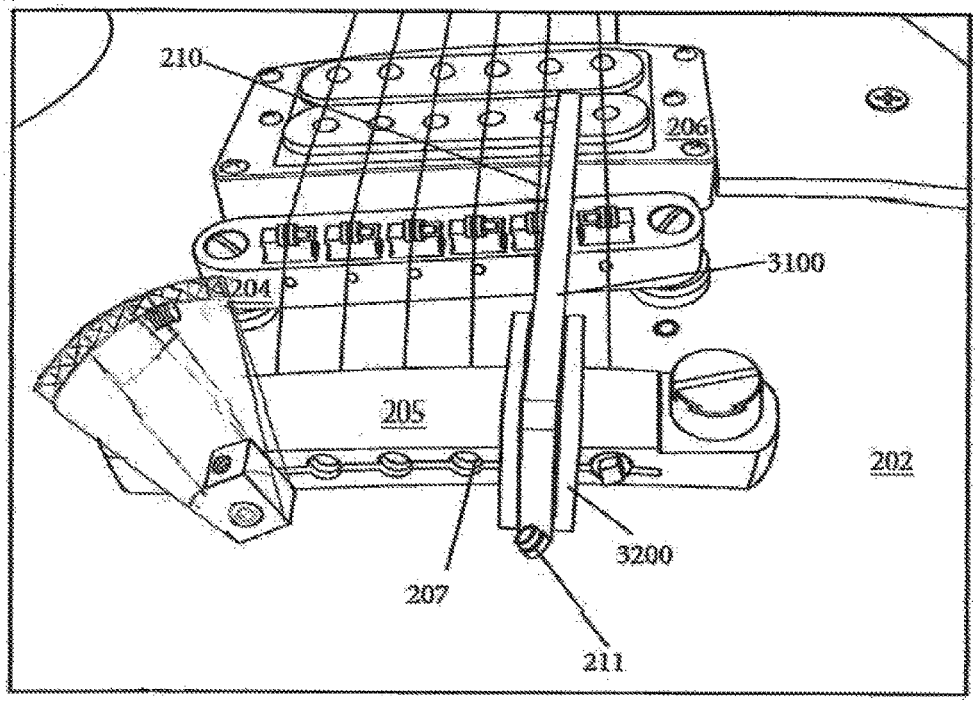
FIG. 8 is a rear view of the pitch adjustment mechanism 3000 of FIG. 8.

FIG. 8 shows a rear view of the pitch adjustment mechanism 3000 installed on the tail piece 205 of an electric guitar 200. As can be appreciated by those of skill in the art, the guitar 200 suitably features: a sound board or top board 202; a bridge and saddle 204; a tail piece 205; a pickup 206, and strings that are secured to the tail piece 205 via a ball end 211. In the depicted embodiment, the pitch changing mechanisms 3000 is coupled to the tail piece via a string 210 with a ball end 211.

Referring to FIGS. 7 and 8, the pitch adjustment mechanism 3000 may be installed on the electric guitar 200 via (a) positioning the base 3200 adjacent a string slot 207 of the tail piece 205; (b) running a string 210 through the string slot of the tail piece 205; and (c) coupling the ball end 211 of the string 210 to the end of the lever arm 3100. In the preferred embodiment, base 3200 is installed so that the pivot pin 3200 located behind the tail piece 205 of the guitar 200, a first end of the lever arm 3100 is provided over the tail piece 205 and strings 210 of the guitar 200, and a second end of the lever arm is provided behind the tail piece 205. Suitably, a string 210 with a ball end 211 may be strung up on the guitar 200 so that the string 210 is pulled taut to the saddle 204, strung through the string slot 207 of the tail piece 205 and, coupled to the back end of the lever arm 3100 via the ball end 211.

In use, the pitch adjustment mechanism 3000 may be used to adjust the pitch of a guitar string 210. This operation may be illustrated with reference to FIG. 7. FIG. 7 shows a first embodiment of the lever-type pitch adjustment mechanism 3000 for an electric guitar 200 coupled to a guitar string 210. As shown, the pitch adjustment mechanism 3000 for an acoustic guitar 200 is coupled to a taut but relaxed guitar string 210, wherein the tension in the string 210 is applied to the back end of the lever arm 3100 so that the back end of the lever arm 3100 is pulled toward the tail piece 305. Suitably, the back end of the lever arm 3100 is run through by the open tuning stop screw 3400, which abuts the base 3200 to keep the string from pulling the lever arm all the way around the pivot pin 3210. Suitably, the extent to which the open tuning stop screw 3400 is provided through the lever arm will determine the initial pitch of the string 210 since the configuration shown in FIG. 7 will be the default position whenever the string 210 is under tension. As can be extrapolated from FIG. 7 and the earlier figures, the lever 3100 may be pulled by hand-action until the down stop screw 3300 abuts the base 3200. Suitably, such action increases the tension in the string 210 by pulling the string 210 through the string slot 207. In a preferred embodiment the increased tension can modify the pitch of the string 210 up to a full tone. As can be appreciated, the amount of pitch adjustment attainable by pulling/pushing the lever can varied up to the limit set by the down stop screw's 3300 gridlocking interaction with the tail piece 205. Suitably, relaxing the lever arm 3100 will cause the lever arm 3100 and string 210 to return to the configuration of FIG. 7 since the string 210 tension will pull on the back end of the lever arm 3100 in the manner illustrated.

Figure 9:
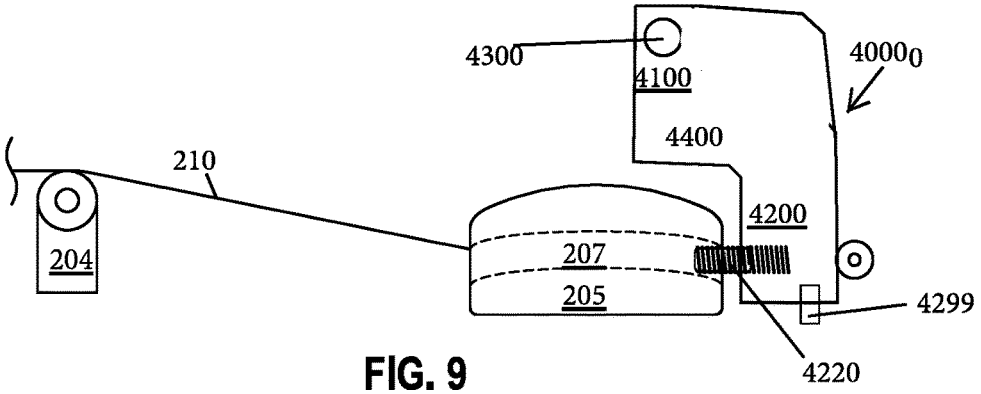
FIG. 9 shows a first embodiment of a rotary-type pitch adjustment mechanism 4000 for an electric guitar 200 coupled to a taut but relaxed guitar string 210.

FIG. 9 shows a cross-section of a first embodiment of a rotary-type pitch adjustment mechanism 4000 for an electric guitar 200. As shown, the pitch adjustment mechanism 4000 may be defined by a lever arm 4100, a knob base 4200, a down stop screw 4300, and an open tuning stop 4400. Suitably, the lever arm 4100 is coupled or otherwise provided to the base 4200 via unitary construction or other joint. As discussed below, the base 4200 features a pulling screw 4220 that may be used to draw the base 4200 toward or away from a tail piece 205 of an electric guitar. In the preferred embodiment, the knob base 4200 is secured to the pulling screw 4220 via a set screw 4299. The distal end of the lever arm 4100, a down stop screw 4300 is provided through the lever arm 4100. A proximate side of the lever arm 4100 defines an open tuning stop 4400. As discussed in greater detail below, the pitch adjustment mechanism 4000 may be installed on an electric guitar (not shown).

Figure 10:
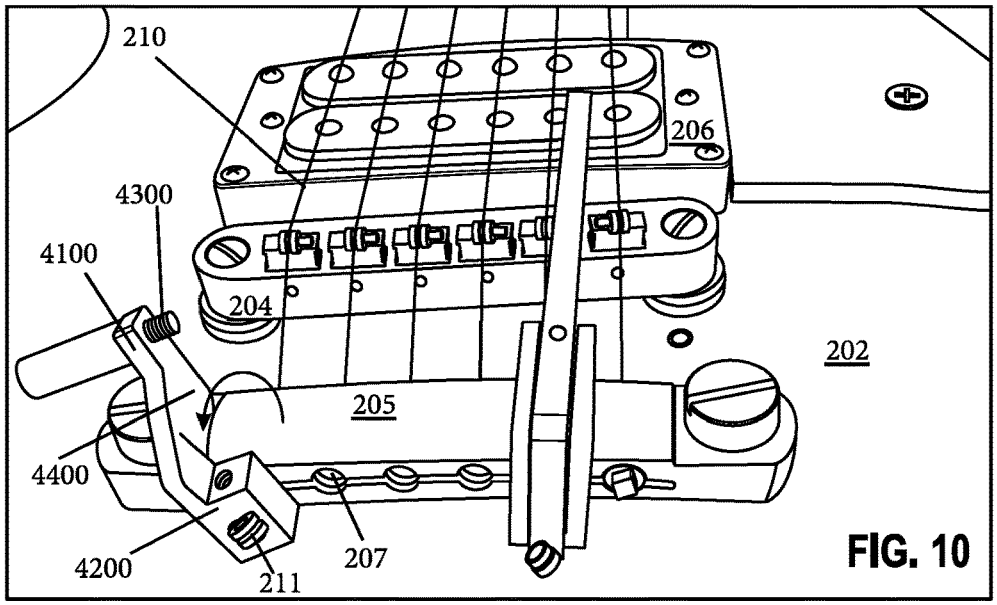
FIG. 10 is a rear view of the pitch adjustment mechanism 4000 of FIG. 9.

FIGS. 9 and 10 show a rear view of the pitch adjustment mechanism 4000 installed on the tail piece 205 of an electric guitar 200. As can be appreciated by those of skill in the art, the guitar 200 suitably features: a sound board or top board 202; a bridge and saddle 204; a tail piece 205; a pickup 206, and strings that are secured to the tail piece 205 via a ball end 211. In the depicted embodiment, the pitch changing mechanisms 4000 is coupled to the tail piece 205 via the threads of the pull screw 4220 screwed inside of the string hole 207 of the tail piece 205. Again, the knob base 4200 is attached to the pull screw 4220 or piston via the locking screw 4299.

Figure 11:
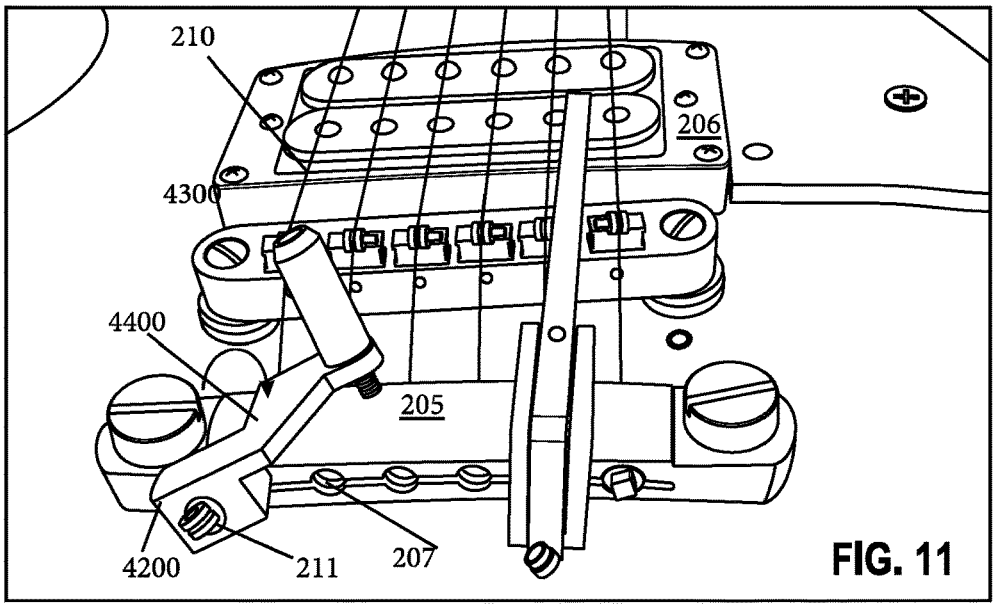
FIG. 11 is a rear view of the pitch adjustment mechanism 4000 of FIG. 9.

Referring to FIGS. 9 through 11, the pitch adjustment mechanism 4000 may be installed on the electric guitar 200 via (a) positioning the base 4200 adjacent a string slot 207 of the tail piece 205; (b) running a string 210 through the string slot of the tail piece 205; (c) coupling the ball end 211 of the string 210 to the base 4200; and (d) threadedly and rotatably coupling the base 4200 to the tail piece 205 via the pulling screw 4220. In the preferred embodiment, base 4200 is installed so that the lever arm 4100 located behind the tail piece 205 of the guitar 200. Suitably, a string 210 with a ball end 211 may be strung up on the guitar 200 so that the string 210 is pulled taut to the saddle 204, strung through the string slot 207 of the tail piece 205, strung through the pulling screw 4220 and, coupled to the base 4200 via the ball end 211.

In use, the pitch adjustment mechanism 4000 may be used to adjust the pitch of a guitar string 210. This operation may be illustrated with reference to FIGS. 9 through 11. FIG. 9 shows a first embodiment of the rotary-type pitch adjustment mechanism 4000 for an electric guitar 200 coupled to a guitar string 210. As shown, the pitch adjustment mechanism 4000 for an electric guitar 200 is coupled to a taut but relaxed guitar string 210, wherein the tension in the string 210 is applied to the back end of the base 4200. Suitably, the stop 4400 of the lever arm 4100 is abutted to the tail piece 205 to keep the string from pulling the lever arm all the way around the pulling screw 4220. Suitably, the abutment of the stop 4400 to the tail piece 205 will determine the initial pitch of the string 210 since the configuration shown in FIG. 10 will be the default position whenever the string 210 is under tension. As can be interpolated from FIGS. 10 and 11, and the earlier figures, the lever 4100 may be pulled by hand-action until the down stop screw 4300 abuts the tail piece 205. Suitably, such action increases the tension in the string 210 by unthreading the pull screw 4220 which in turn pulls the string 210 through the string slot 207. In a preferred embodiment the increased tension can modify the pitch of the string 210 up to a full tone. As can be appreciated, the amount of pitch adjustment attainable by pulling/pushing the lever can varied up to the limit set by the down stop screw's 4300 gridlocking interaction with the tail piece 205. Suitably, relaxing the lever arm 4100 will cause the lever arm 4100 and string 210 to return to the configuration of FIG. 10 since the string 210 tension will pull on the back end of the lever arm 4100 in the manner illustrated.

Figure 12:
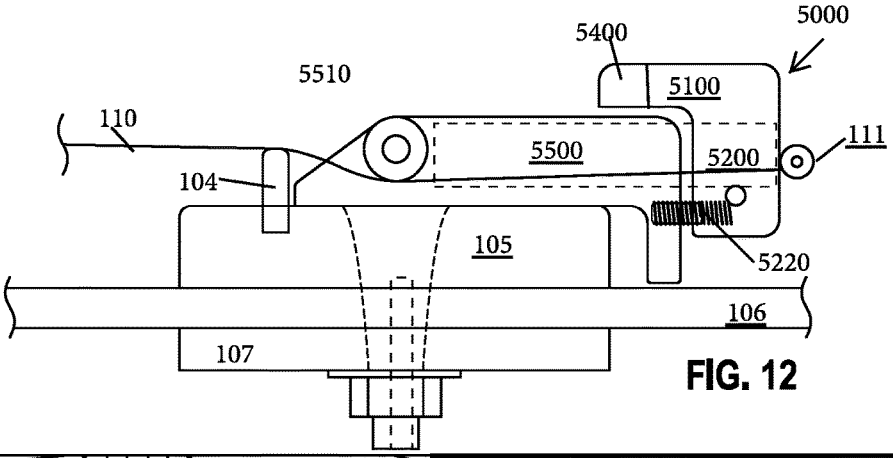
FIG. 12 shows a first embodiment of a rotary-type pitch adjustment mechanism 5000 for an acoustic guitar 100 coupled to a taut but relaxed guitar string 110.

FIG. 12 shows a cross-section of a first embodiment of a rotary-type pitch adjustment mechanism 5000 for an acoustic guitar 100. As shown, the pitch adjustment mechanism 5000 may be defined by a lever arm 5100 (defined by an arched knob, as shown), a base 5200, a down stop screw 5300, and an open tuning stop 5400. Suitably, the lever arm 5100 is coupled or otherwise provided to the base 5200 via unitary construction or other joint. As discussed below, the base 5200 features a pulling screw 5220 that may be used to draw the base 5200 toward or away from a bridge 105 of an acoustic guitar. The distal end of the lever arm 5100 may suitably be T-shaped with a down stop screw 5300 provided on one side of the T-shape and the other side of the T-shape defining an open tuning stop 5400. The pitch changer 500 further comprises a roller housing 5500 coupled to the bridge 105 of a guitar 100 and a roller 5510. As discussed in greater detail below, the pitch adjustment mechanism 5000 may be installed on the bridge 205 of an acoustic guitar (not shown).

Figure 13:
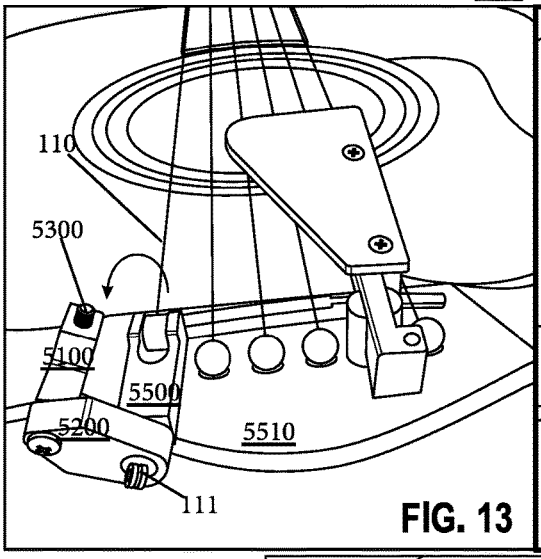
FIG. 13 is a rear view of the pitch adjustment mechanism 4000 of FIG. 12.
Figure 14:
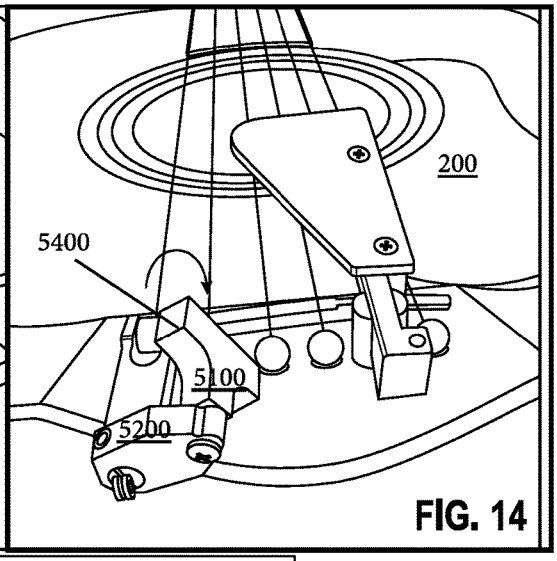
FIG. 14 is a rear view of the pitch adjustment mechanism 4000 of FIG. 12.
Figure 15:
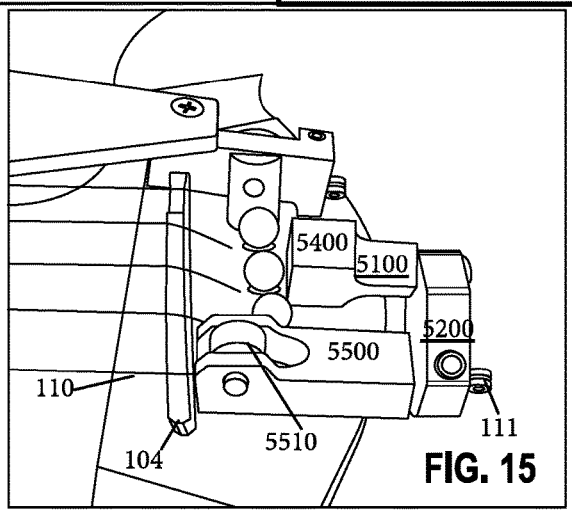
FIG. 15 is a side view of the pitch adjustment mechanism 4000 of FIG. 14.

FIGS. 13 and 14 show a rear view of the pitch adjustment mechanism 5000 installed on the bridge 105 of an acoustic guitar 100. FIG. 15 shows a side view of the pitch adjustment mechanism 5000 in the configuration of FIG. 14. As can be appreciated by those of skill in the art, the guitar 100 suitably features: a sound board or top board 102; a sound hole 103; a saddle 104; a bridge 105; and strings that are secured to the bridge 105 via either a bridge pin 106 or a ball end 111. In the depicted embodiment, the pitch changing mechanisms has replaced a bridge pin 106 and is coupled to a string 110 with a ball end 111.

Referring to FIGS. 12 through 15, the pitch adjustment mechanism 5000 may be installed on the acoustic guitar 100 via (a) installing the roller housing 5500 in the bridge pin slot 107 using a flat-head screw and threaded bushing inside the instrument; (b) positioning the base 5200 adjacent the roller housing 5500; (c) running a string 110 through the roller 5510 and roller housing 5500; (d) coupling the ball end 111 of the string 110 to the base 5200; and (e) threadedly and roatably coupling the base 5200 to the roller housing 5500 via the pulling screw 5220. In the preferred embodiment, base 5200 is installed so that the lever arm 5100 is located behind the roller housing 5500. Suitably, a string 110 with a ball end 111 may be strung up on the guitar 100 so that the string 110 is pulled taut to the saddle 104 (see FIG. 15), strung through the roller 5510 and roller housing 5500 and, coupled to the base 5200 via the ball end 111.

In use, the pitch adjustment mechanism 5000 may be used to adjust the pitch of a guitar string 110. This operation may be illustrated with reference to FIGS. 13 through 14. FIG. 13 shows a first embodiment of the rotary-type pitch adjustment mechanism 5000 for an acoustic guitar 100 coupled to a guitar string 110. As shown, the pitch adjustment mechanism 5000 for an acoustic guitar 100 is coupled to a taut but relaxed guitar string 110, wherein the tension in the string 110 is applied to the back end of the base 5200. Suitably, the stop 5400 of the lever arm 5100 is abutted to the bridge 105 to keep the string 110 from pulling the lever arm 5100 all the way around the pulling screw 5220. Suitably, the abutment of the stop 5400 to the tail piece 105 will determine the initial pitch of the string 110 since the configuration shown in FIG. 13 will be the default position whenever the string 110 is under tension. As can be interpolated from FIGS. 13 and 14, and the earlier figures, the lever 5100 may be pulled by hand-action until the down stop screw 5300 abuts the bridge 105. Suitably, such action increases the tension in the string 110 by unthreading the pull screw 5220 which in turn pulls the string 110 through the roller 5510. In a preferred embodiment the increased tension can modify the pitch of the string 110 up to a full tone. As can be appreciated, the amount of pitch adjustment attainable by pulling/pushing the lever can varied up to the limit set by the down stop screw's 5300 gridlocking interaction with the tail piece 105. Suitably, relaxing the lever arm 5100 will cause the lever arm 5100 and string 110 to return to the configuration of FIG. 13 since the string 110 tension will pull on the back end of the lever arm 5100 in the manner illustrated.

Figure 16:
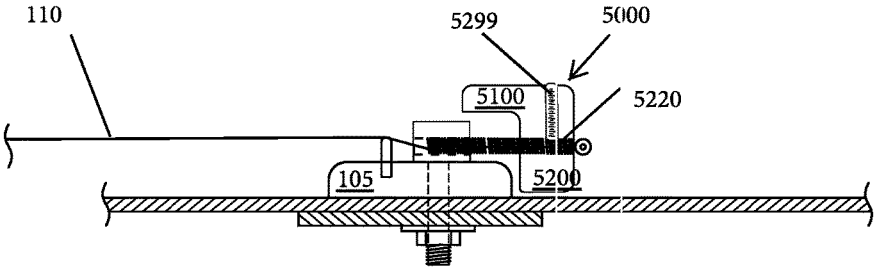
FIG. 16 shows a cross-section of a different embodiment of a rotary-type pitch adjustment mechanism 5000 for an acoustic guitar.
Figure 17:
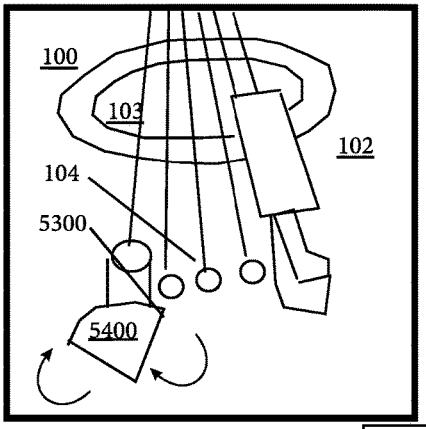
FIG. 17 shows a rear view of the pitch adjustment mechanism 5000 installed on the bridge 105 of an acoustic guitar 100.

FIG. 16 shows a cross-section of a different embodiment of a rotary-type pitch adjustment mechanism 5000 for an acoustic guitar 100. FIG. 17 shows a rear view of the pitch adjustment mechanism 5000 installed on the bridge 105 of an acoustic guitar 100. As shown, the pitch adjustment mechanism 5000 may be defined by an arched knob 5100 (defined by an arched knob, as shown), a base 5200, a down stop 5300 (FIG. 17), and an open tuning stop 5400 (FIG. 17). Suitably, the arched knob 5100 is coupled or otherwise provided to the base 5200 via unitary construction or other joint. As discussed below, the base 5200 features a pulling screw 5220 that may be used to draw the base 5200 toward or away from a bridge 105 of an acoustic guitar. The pulling screw 5200 couples to the arched knob via a set screw 5299. The arched knob 5100 and base 5200 may suitably be pie-slice shaped with a down stop 5300 provided on one side of the pie-slice-shape and the other side of the pie-shape defining an open tuning stop 5400. The pitch adjustment mechanism 5000 may be installed on the bridge 205 of an acoustic guitar 100.

FIG. 17 shows a rear view of the pitch adjustment mechanism 5000 installed on the bridge 105 of an acoustic guitar 100. As can be appreciated by those of skill in the art, the guitar 100 suitably features: a sound board or top board 102; a sound hole 103; a saddle 104; a bridge 105; and strings 110 that are secured to the bridge 105 via either a bridge pin 106 or a ball end 111. In the depicted embodiment, the pitch changing mechanisms 5000 has been coupled to the bridge via threaded pull screw 5220 and is coupled to a string 110 with a ball end 111.

In use, the pitch adjustment mechanism 5000 may be used to adjust the pitch of a guitar string 110. This operation may be illustrated with reference to FIG. 17. FIG. 17 shows the rotary-type pitch adjustment mechanism 5000 for an acoustic guitar 100 coupled to a guitar string 110. As shown, the pitch adjustment mechanism 5000 for an acoustic guitar 100 is coupled to a taut but relaxed guitar string 110, wherein the tension in the string 110 is applied to the back end of the base 5200. Suitably, the stop 5400 of the lever arm 5100 is abutted to the top board 102 to keep the string 110 from pulling the lever arm 5100 all the way around the pulling screw 5220. Suitably, the abutment of the stop 5400 to the top board 102 will determine the initial pitch of the string 110 since the configuration shown in FIG. 17 will be the default position whenever the string 110 is under tension. As can be extrapolated from FIG. 17, and the earlier figures, the lever 5100 may be pulled by hand-action until the down stop screw 5300 abuts the op plate 102. Suitably, such action increases the tension in the string 110 by unthreading the pull screw 5220 which in turn pulls the string 110 through the roller 5510. In a preferred embodiment the increased tension can modify the pitch of the string 110 up to a full tone. As can be appreciated, the amount of pitch adjustment attainable by pulling/pushing the lever can varied up to the limit set by the down stop screw's 5300 gridlocking interaction with the tail piece 105. Suitably, relaxing the lever arm 5100 will cause the lever arm 5100 and string 110 to return to the configuration of FIG. 16 since the string 110 tension will pull on the back end of the lever arm 5100 in the manner illustrated.

Figure 18:
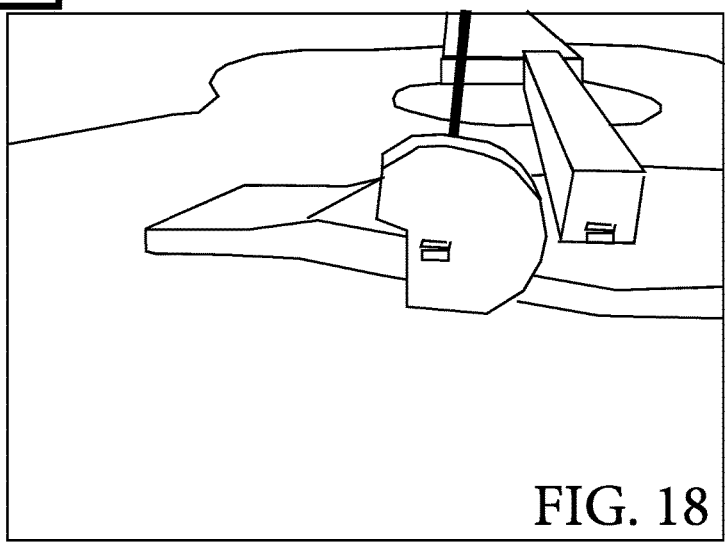
FIG. 18 shows an alternate version of the arched knob 5100 disclosed above in connection with FIGS. 16 through 17.

FIG. 18 shows an alternate version of the arched knob 5100 disclosed above in connection with FIGS. 16 through 17. Suitably, the arched knob 5100 may be knurled around the top so that a user may use his or her wrist or arm to twist the knob 5100 while playing the strings 110 of the instrument 100.

Figure 19:
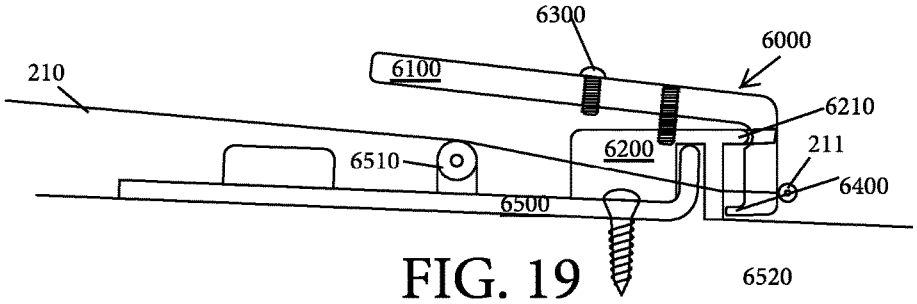
FIG. 19 shows a first embodiment of a lever-type pitch adjustment mechanism 6000 for a Telecaster-type electric guitar 200 coupled to a taut but relaxed guitar string 210.

FIG. 19 shows a cross-section of another embodiment of a lever-type pitch adjustment mechanism 6000 for an electric guitar 200. FIG. 17 shows an exploded view of the pitch adjustment mechanism 6000. As shown, the pitch adjustment mechanism 6000 may be defined by a lever arm 6100, a base 6200, a down stop screw 6300, and an open tuning stop 6400. Suitably, the lever arm 6100 is coupled to the base 6200 via a pivot or fulcrum 6210. On one side of the pivot 6210, a down stop screw 6300 is provided through the lever arm 6100. The other side of the pivot pin 6210 defines an open tuning stop 6400. As discussed in greater detail below, the pitch adjustment mechanism 6000 may be installed on an electric guitar (not shown).

Figure 20:
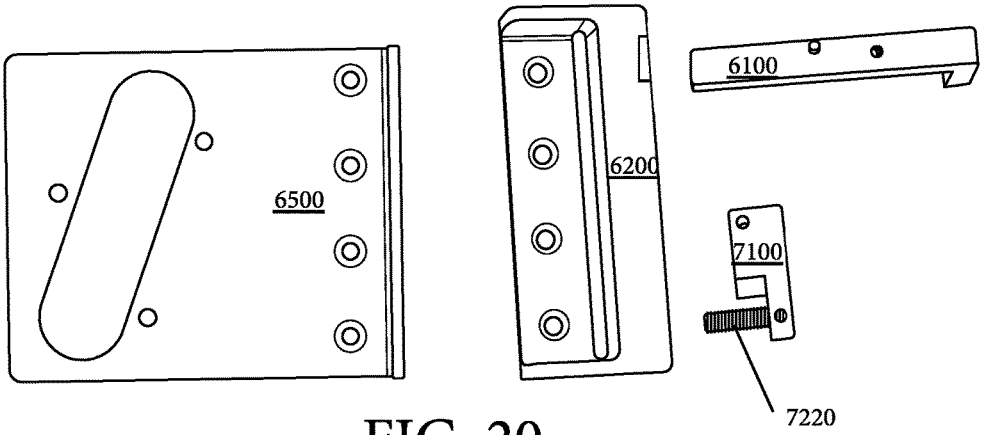
FIG. 20 is an exploded top view of the lever pitch adjustment mechanism 6000 of FIG. 16 and a rotary pitch adjustment mechanism 7000.
Figure 21A:
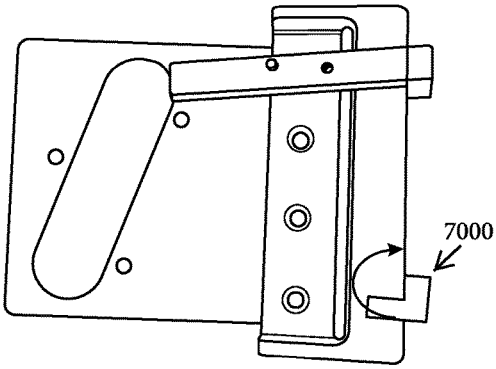
FIG. 21A is an assembled top view of the pitch adjustment mechanisms 6000, 7000.
Figure 21B:
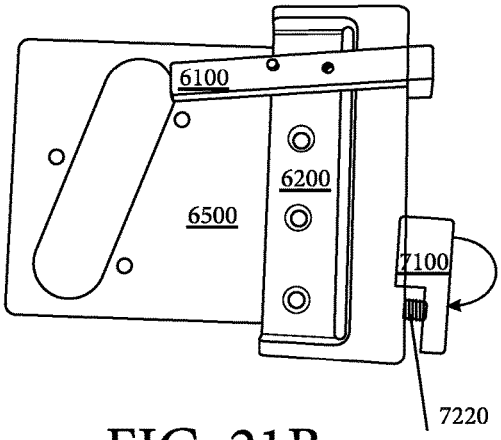
FIG. 21B is an assembled top view of the pitch adjustment mechanism 6000, 7000.

FIG. 20 shows an exploded view of the pitch adjustment mechanism 6000.

Referring to FIGS. 19 and 20, the pitch adjustment mechanism 6000 may be installed on the electric guitar 200 via (a) positioning the base 6200 over a lip of the pickup plate 6500; (b) running a string 210 through the roller 6510 and the base 6200; and (c) coupling the ball end 211 of the string 210 to the end of the lever arm 6100. In the preferred embodiment, base 6200 is installed so that the pivot 6200 is located behind the pickup plate 6500, a first end of the lever arm 6100 is provided over lip 6520 of the pickup plate 6500 and strings 210 of the guitar 200, and a second end of the lever arm is provided behind base 6200. Suitably, a string 210 with a ball end 211 may be strung up on the guitar 200 so that the string 210 is pulled taut to the saddle 204, strung through the roller 6510 and, coupled to the back end of the lever arm 6100 via the ball end 211.

In use, the pitch adjustment mechanism 6000 may be used to adjust the pitch of a guitar string 210. This operation may be illustrated with reference to FIG. 19. FIG. 19 shows a first embodiment of the lever-type pitch adjustment mechanism 6000 for an electric guitar 200 coupled to a guitar string 210. As shown, the pitch adjustment mechanism 6000 for an acoustic guitar 200 is coupled to a taut but relaxed guitar string 210, wherein the tension in the string 210 is applied to the back end of the lever arm 6100 so that the back end of the lever arm 6100 is pulled toward the base 6200. Suitably, the back end of the lever arm 6100 is defined by the open tuning stop 6400, which abuts the base 6200 to keep the string from pulling the lever arm 6100 all the way around the pivot 6210. Suitably, the extent to which the open tuning stop 66400 is provided to the lever arm will determine the initial pitch of the string 210 since the configuration shown in FIG. 19 will be the default position whenever the string 210 is under tension. As can be extrapolated from FIG. 19 and the earlier figures, the lever 6100 may be pulled by hand-action until the down stop screw 6300 abuts the base 6200. Suitably, such action increases the tension in the string 210 by pulling the string 210 through the roller 6510. In a preferred embodiment the increased tension can modify the pitch of the string 210 up to a full tone. As can be appreciated, the amount of pitch adjustment attainable by pulling/pushing the lever can varied up to the limit set by the down stop screw's 6300 gridlocking interaction with the base 6200. Suitably, relaxing the lever arm 6100 will cause the lever arm 6100 and string 210 to return to the configuration of FIG. 19 since the string 210 tension will pull on the back end of the lever arm 6100 in the manner illustrated.

FIGS. 20A and 20B show an assembled rotary-type pitch adjustment mechanism 7000 for an electric guitar. As shown, the pitch adjustment mechanism 7000 may be defined by a lever arm 7100, a base 6200, and other components described above in connection with the other rotary type pitch changers. Suitably, the lever arm 4100 is coupled or otherwise provided to the base 4200 via a pulling screw 7220 that may be used to draw the lever arm 7100 toward or away from the base 6200.

FIGS. 20A and 20B show a top view of the pitch adjustment mechanism 7000 installed on the pickup plate 6500 of an electric guitar 200. As can be appreciated by those of skill in the art, the guitar 200 suitably features: a sound board or top board 202; a bridge and saddle 204; a tail piece 205; a pickup 206, and strings that are secured to the tail piece 205 via a ball end 211. In the depicted embodiment, the pitch changing mechanisms 4000 are coupled to the tail piece 205. Referring still to FIGS. 20A and 20B, the pitch adjustment mechanism 7000 may be installed and operated on the electric guitar 100 in the manner described above in connection with rotary type pitch adjusters.

Figure 22:
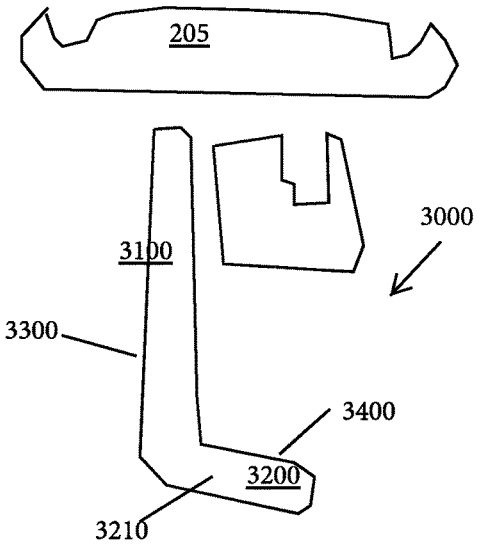
FIG. 22 shows an exploded view of another embodiment of a lever-type pitch adjustment mechanism 3000 for an electric guitar 200.
Figure 23:
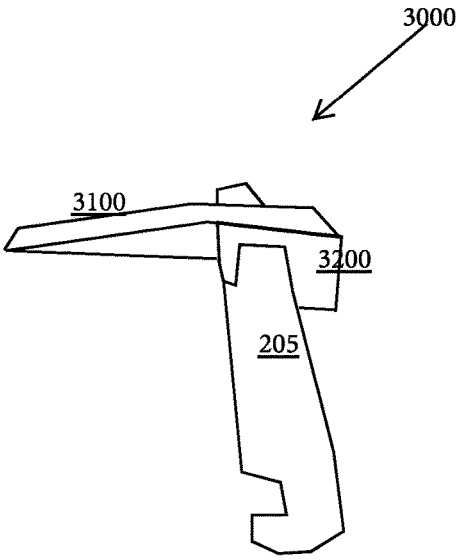
FIG. 23 shows an assembled view of the pitch adjustment mechanism 3000 of FIG. 22.

FIG. 22 shows an exploded view of another embodiment of a lever-type pitch adjustment mechanism 3000 for an electric guitar 200. FIG. 23 shows an assembled view of the pitch adjustment mechanism 3000 of FIG. 22. As shown, the pitch adjustment mechanism 3000 may be defined by a lever arm 3100, a base 3200, a down stop screw 3300, and an open tuning stop screw 3400. Suitably, the lever arm 3100 is coupled to the base 3200 via a pivot or fulcrum pin 3210. On one side of the pivot pin 3210, a down stop screw 3300 is provided through the lever arm 3100. On another side of the pivot pin 3210, an open tuning stop screw 3400 is provided through the lever arm 3100. As discussed in greater detail below, the pitch adjustment mechanism 3000 may be installed on an electric guitar (not shown).

Figure 24:
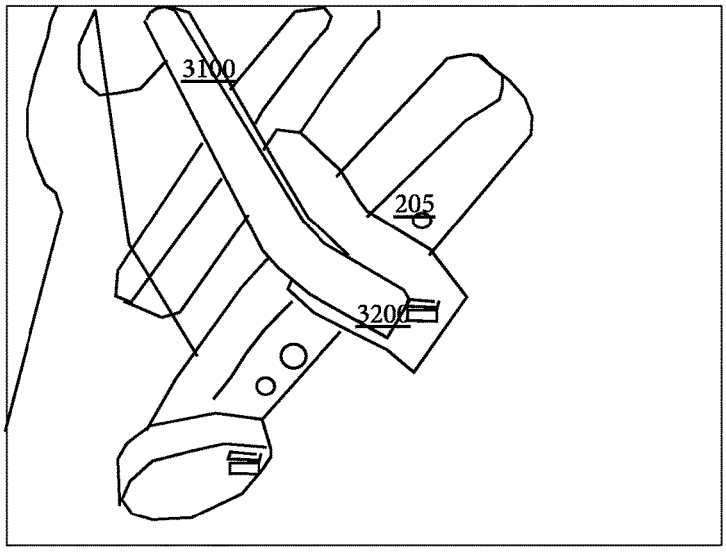
FIG. 24 shows a rear view of the pitch adjustment mechanism 3000 installed on the tail piece 205 of an electric guitar 200.

FIG. 24 shows a rear view of the pitch adjustment mechanism 3000 installed on the tail piece 205 of an electric guitar 200. As can be appreciated by those of skill in the art, the guitar 200 suitably features: a sound board or top board 202; a bridge and saddle 204; a tail piece 205; a pickup 206, and strings that are secured to the tail piece 205 via a ball end 211. In the depicted embodiment, the pitch changing mechanisms 3000 is coupled to the tail piece via a string 210 with a ball end 211.

Referring to FIGS. 22 through 24, the pitch adjustment mechanism 3000 may be installed on the electric guitar 100 via (a) positioning the base 3200 adjacent a string slot 207 of the tail piece 205; (b) running a string 210 through the string slot 207 of the tail piece 205; (c) running the string through a cannulated screw provided to the string hole 207; and (d) coupling the ball end 211 of the string 210 to the end of the lever arm 3100. In the preferred embodiment, base 3200 is installed so that the pivot pin 3200 located behind the tail piece 205 of the guitar 200, a first end of the lever arm 3100 is provided over the tail piece 205 and strings 210 of the guitar 200, and a second end of the lever arm is provided behind the tail piece 205. Suitably, a string 210 with a ball end 211 may be strung up on the guitar 200 so that the string 210 is pulled taut to the saddle 204, strung through the string slot 207 of the tail piece 205 and, coupled to the back end of the lever arm 3100 via the ball end 211.

Figure 25:
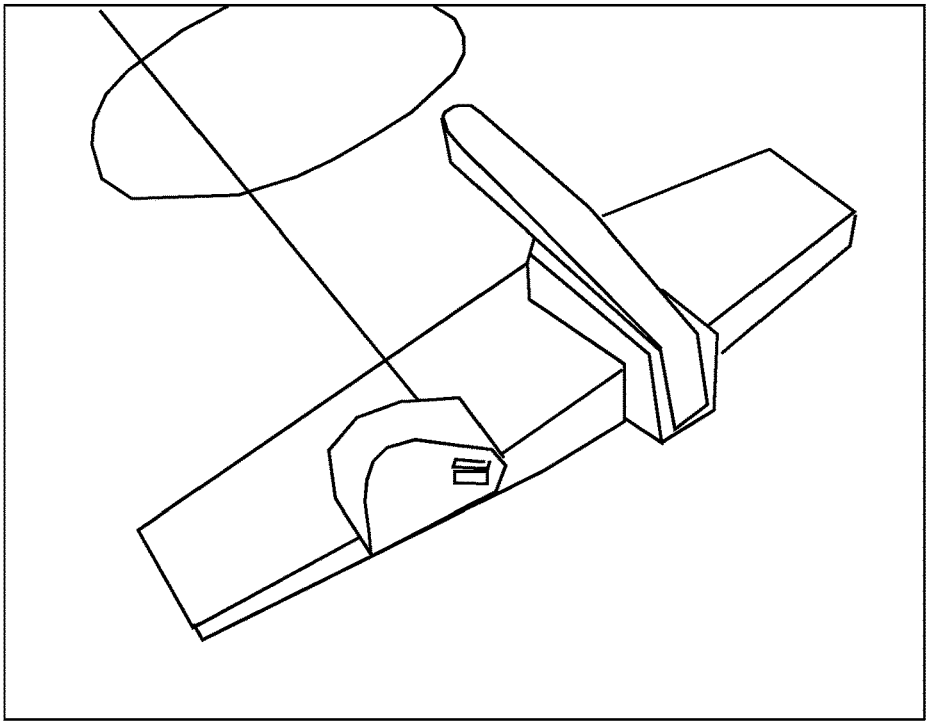
FIG. 25 shows another embodiment of the pitch changing mechanisms.
Figure 26:
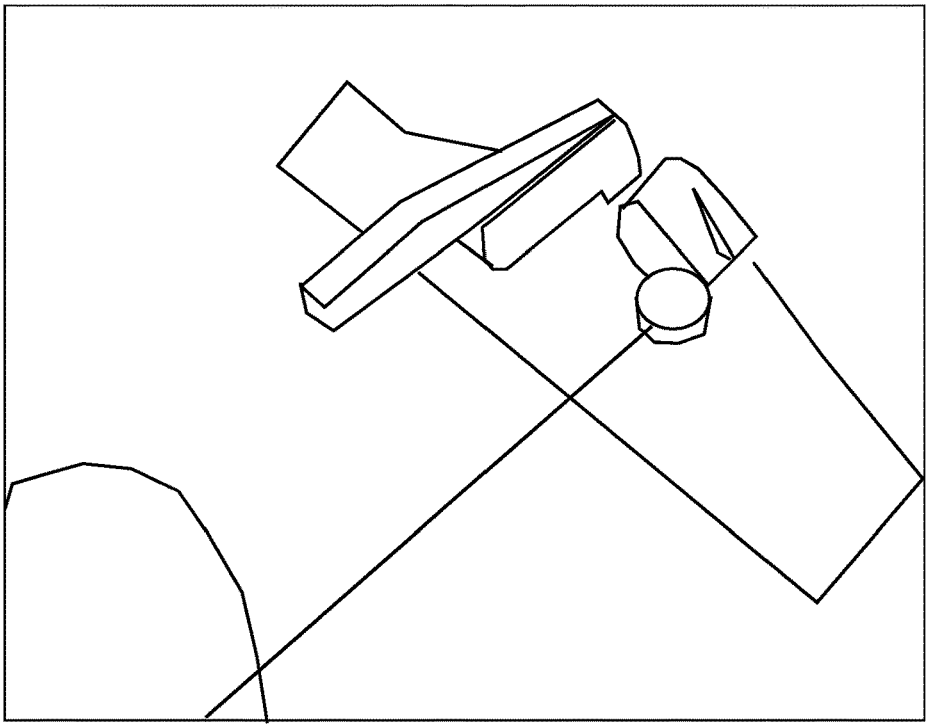
FIG. 26 shows another embodiment of the pitch changing mechanisms.

FIGS. 25 and 26 show various other embodiments of the pitch changing mechanisms disclosed above.

Figure 27:
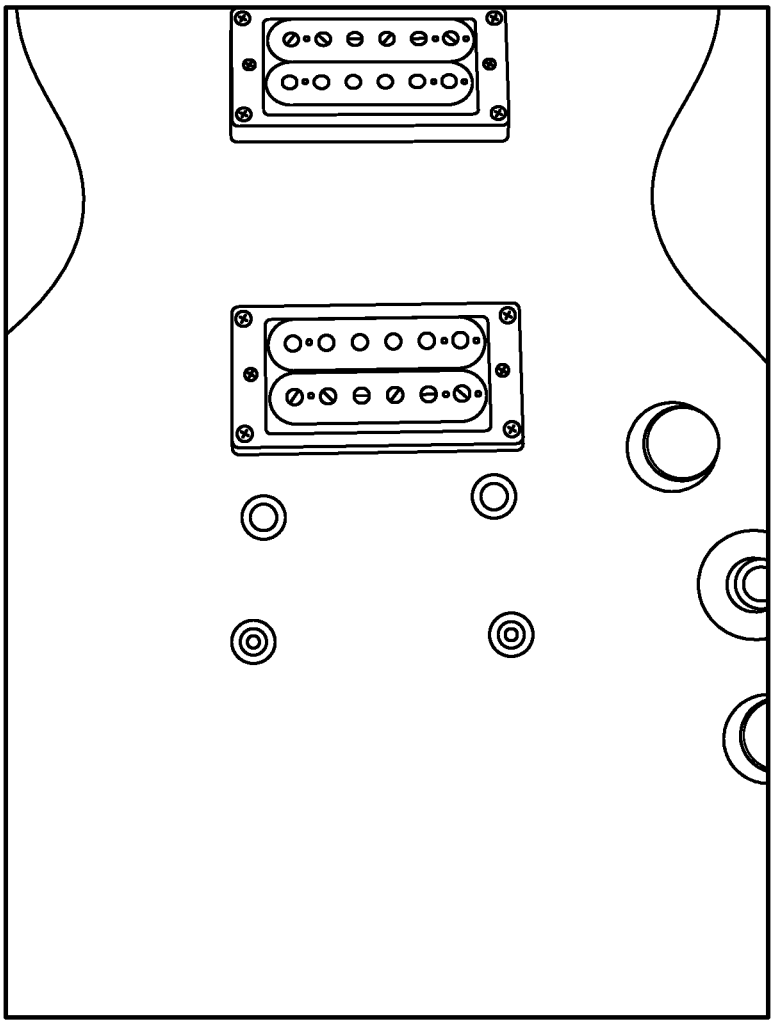
FIG. 27 is a top view of an electric guitar with a bridge and tailpiece removed.
Figure 28:
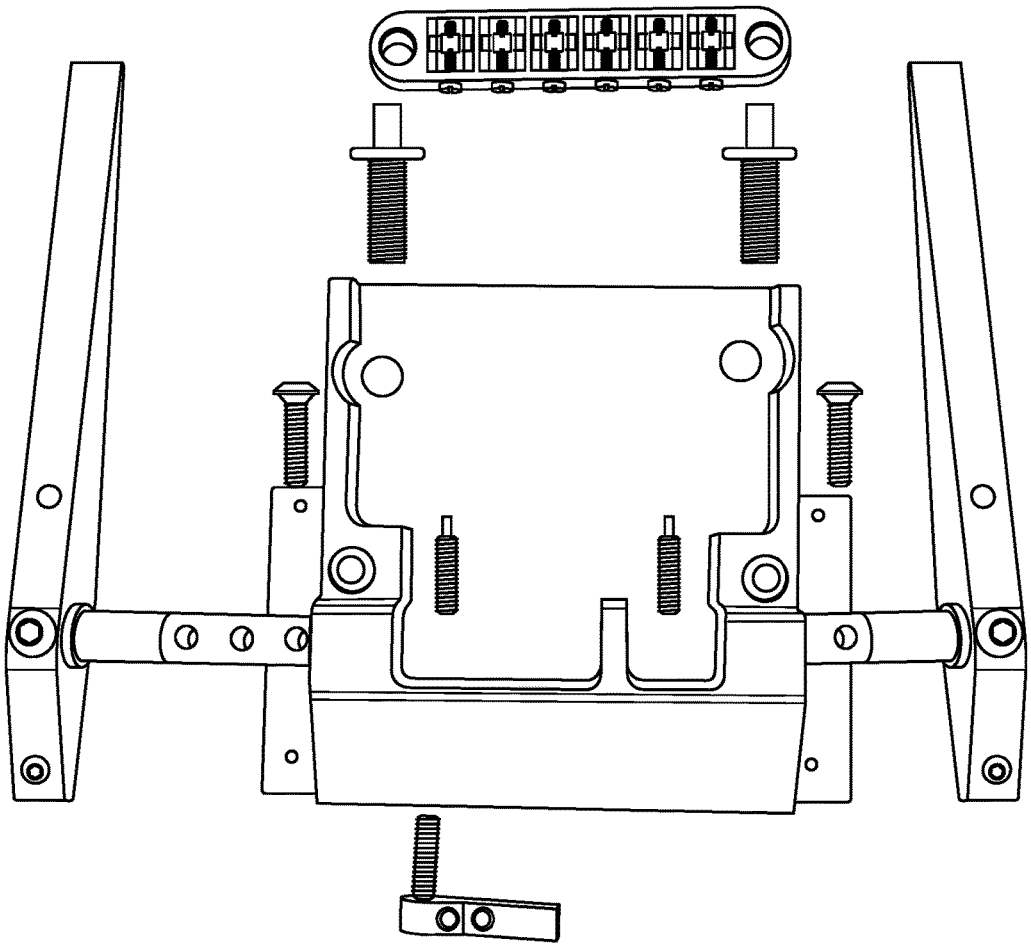
FIG. 28 is an exploded top view of a pitch changing mechanism.
Figure 29:
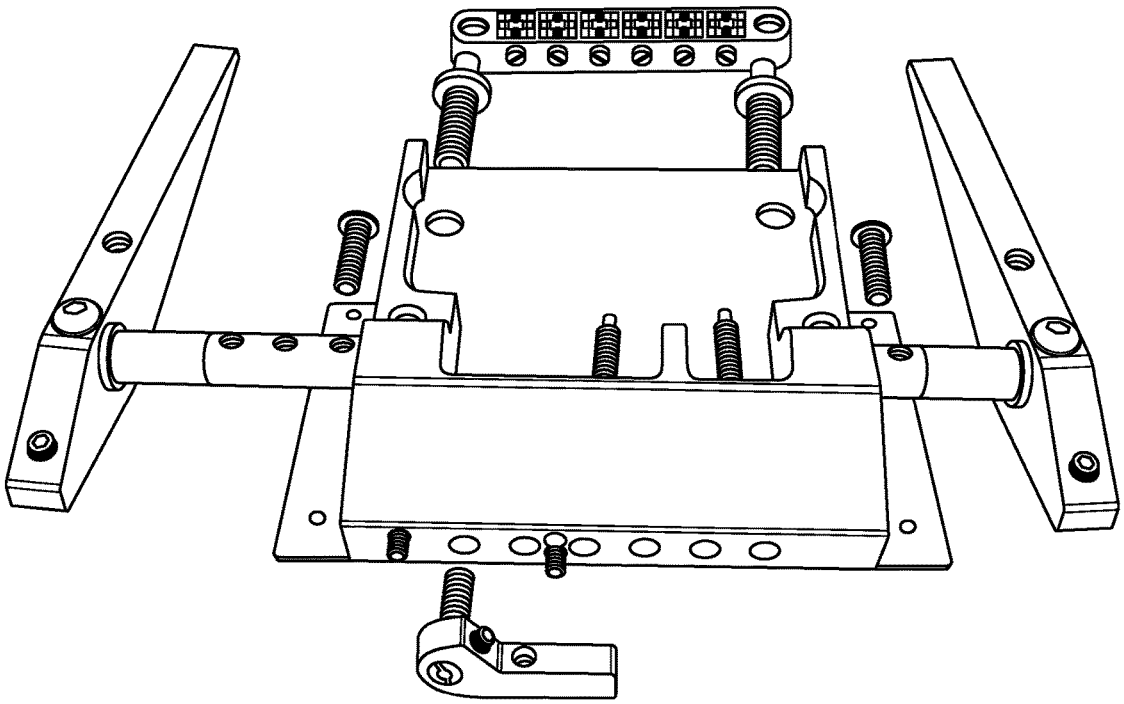
FIG. 29 is an exploded end view of the pitch changer with a split shaft design, two levers and a rotary lever.
Figure 30:
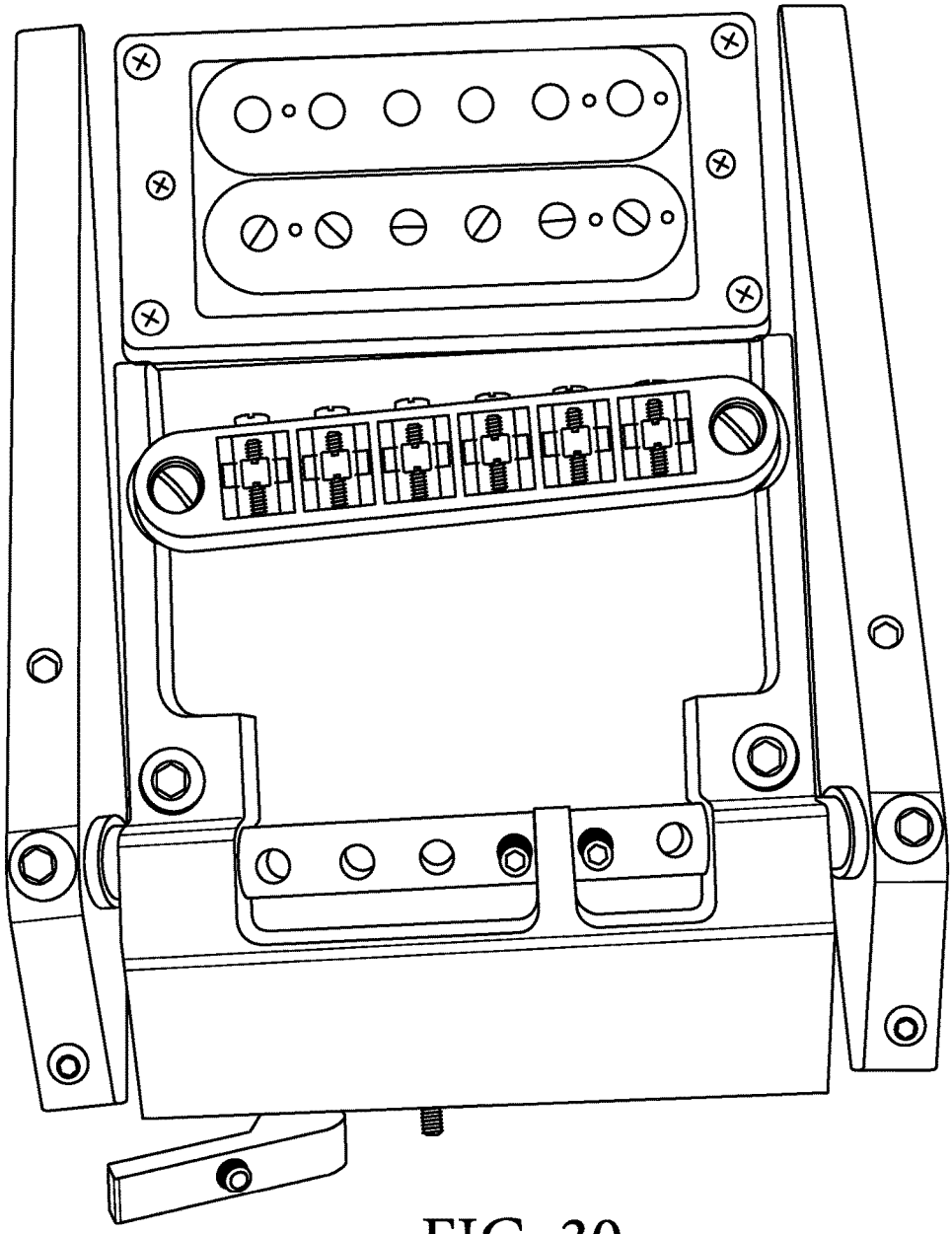
FIG. 30 is an assembled view of the pitch changer of FIG. 28.

FIG. 27 is a top view of an electric guitar with a bridge and tailpiece removed. FIG. 28 is an exploded top view of a pitch changing mechanism with both lever type and rotary type pitch changing capabilities. FIG. 29 is an exploded end view of the pitch changer with a split shaft design, two levers and a rotary lever. Two shafts, side-by-side could also be employed. FIG. 30 is an assembled view of the pitch changer of FIG. 29. The depicted device accommodates two individual lever type string pitch changers (on either side), that operate on separate parts of a split shaft design. The device also incorporates the rotary lever. The lever type pitch changers and rotary type pitch changers operate according to the principles recited above in connection with the other figures. For installation, the pitch changing device may be mounted using the holes used in the original bride and tail piece.

Figure 31:
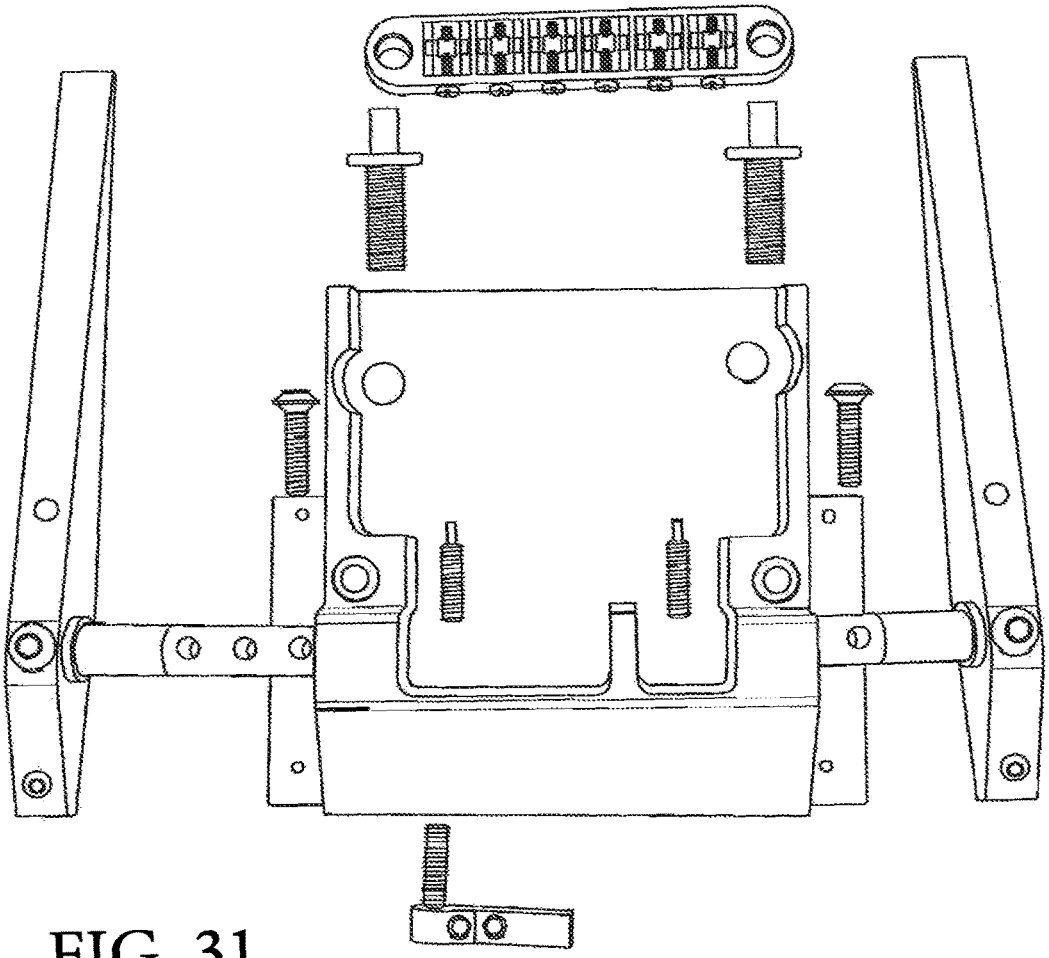
FIG. 31 is an exploded top view of a pitch changing mechanism.
Figure 32:
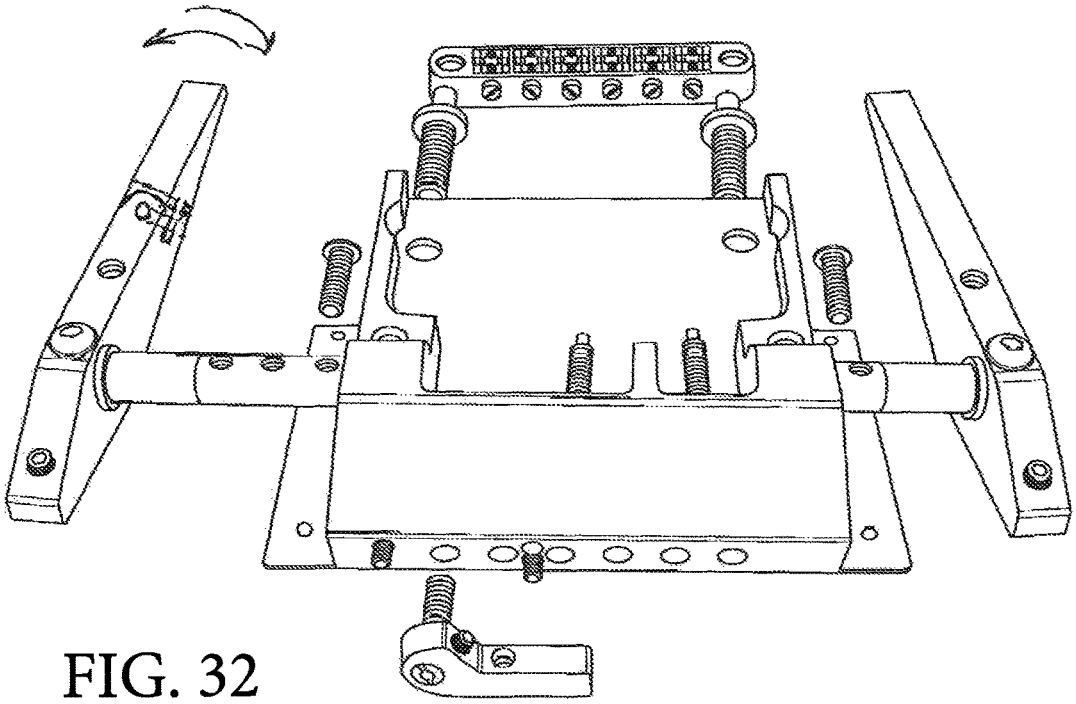
FIG. 32 is an exploded end view of the pitch changer with a split shaft design, two levers and a rotary lever.
Figure 33:
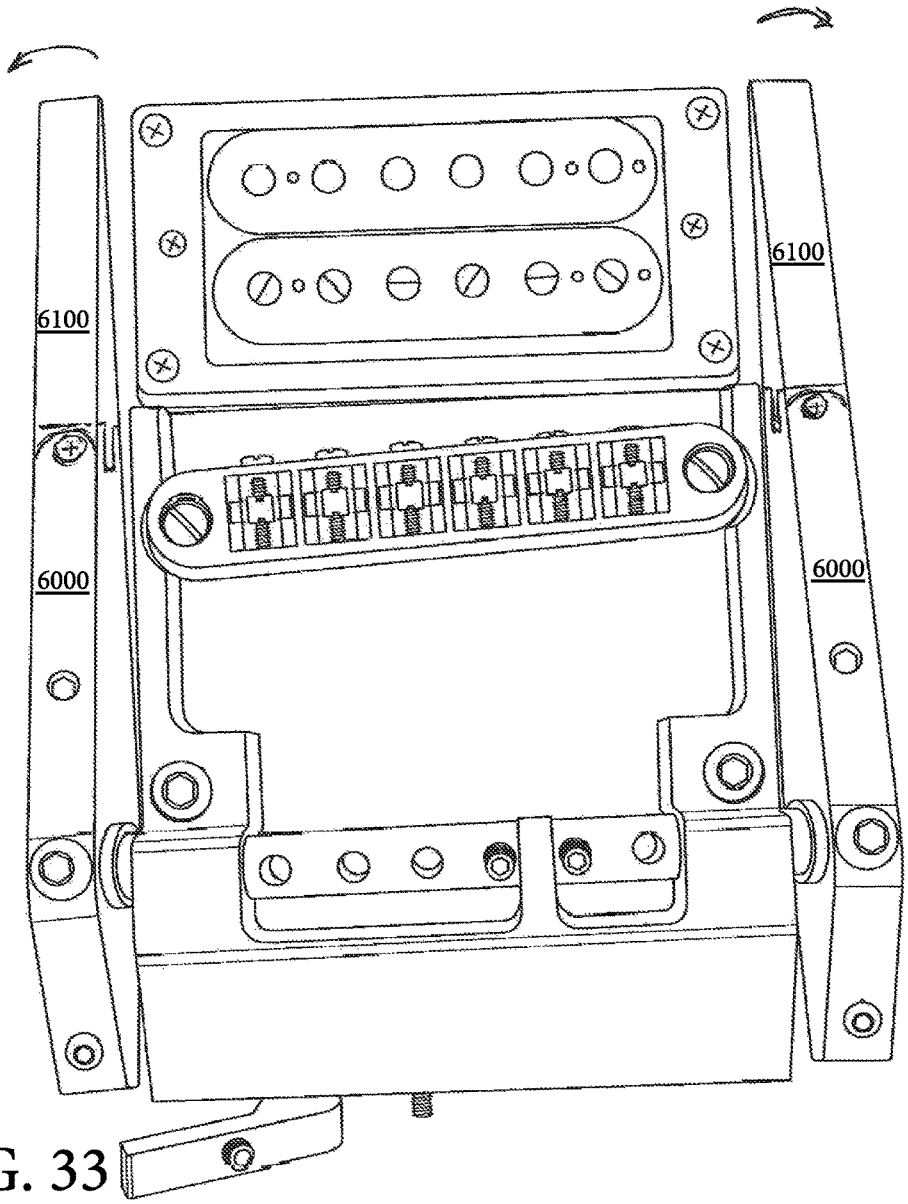
FIG. 33 is an assembled view of the pitch changer of FIG. 31.
Figure 34:
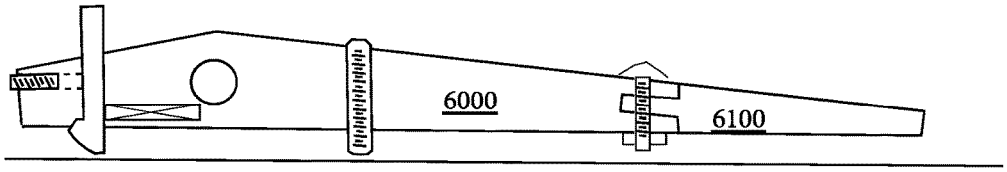
FIG. 34 is a cross section of the pitch changer of FIG. 33
Figure 35:
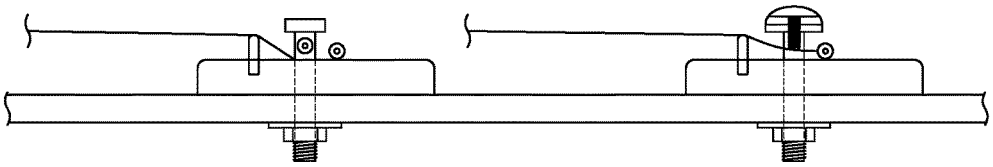
FIG. 35 is a cross section of a roller and knurl pins.

FIG. 31 is an exploded top view of a pitch changing mechanism with both lever type and rotary type pitch changing capabilities. FIG. 32 is an exploded end view of the pitch changer with a split shaft design, two levers and a rotary lever. Two shafts, side-by-side could also be employed. FIG. 33 is an assembled view of the pitch changer of FIG. 32. FIG. 34 is a cross section of pitch change assembly in FIGS. 31 through 33. The depicted device accommodates two individual lever type string pitch changers (on either side), that operate on separate parts of a split shaft design. The device also incorporates the rotary lever. The lever type pitch changers and rotary type pitch changers operate according to the principles recited above in connection with the other figures.

Referring to FIGS. 34 and 33, the device depicted suitably features a lever arm 6000 with a swivel digit 6100. Suitably, the swivel digit 6100 adds a swivel handle or lever for players' comfort and ease of play. Suitably, the swivel handle 6100 places the end of the lever at a location that is reachable via the player while still playing the instrument. This feature enables the player to change the pitch of strings without moving hands. Suitably, the lever enables plucking of the strings while changing the pitch of the string without moving hand placement.

Some embodiments include a roller pin and a knurl screw pin. The roller pin and knurl screw pin are intended to replace existing pins in acoustic guitars. Typical string pins can be challenging to remove when re-stringing. The roller and knurl pins, on the other hand, are simply inserted through the pin hole and secured with a washer and nut inside the guitar cavity. The roller and knurl pins suitably provide additional down pressure on a string to prevent string buzz. The roller and knurl pins suitably also make stringing of the musical instrument easier because strings can be changed simply by loosening the associated screw and pulling the string through to attachment. String replacement may suitably be accomplished in a similar manner. Once a string is in place the roller or knurl pin may be tightened to secure the string. Additionally, the operation of pins through the instruments face instead of through the bridge of the instrument reduces 'bridge lifting" (i.e., the separation of bridge from the instrument's face under string tension).

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A rotary-type pitch changer device comprising:

a knurly arched knob coupled to a mounting mechanism;

a cannulated mounting screw;

a down stop screw; and an open tuning stop screw, wherein the arched knob is coupled to the mounting screw and a string of a stringed musical instrument, and wherein the string of the musical instrument is provided through the cannulated screw so that rotating the knurly arched knob manipulates the pitch of the string by adjusting string tension, and wherein the down stop screw limits movement of the arched knob towards the string to set a maximum tension on the string, and wherein the open tuning stop screw limits movement of the arched knob away from the string to set a minimum tension on the string.

2. The device of claim 1, further comprising a roller, wherein the roller is coupled to the mounting mechanism and supports the string and accommodates movement of the strings by changes to string tension during rotation of the arched knob.

3. The device of claim 1, wherein the mounting mechanism is configured to correspond to existing mounting holes of a stringed musical instrument without modification.

4. The device of claim 1, wherein the mounting mechanism is pivotably attached to the stringed musical instrument to permit the pitch changer to move out of the way from a user's hands.

5. The device of claim 1, further comprising a base positioned adjacent to the mounting mechanism and configured to adjust a height of the string relative to the stringed musical instrument.

6. The device of claim 1, wherein the arched knob includes an outer surface with a texture that allows a user's arm and wrist to turn the arched knob.

7. A lever-type pitch changer device for a stringed musical instrument with an internal cavity, said pitch changer comprising:

a lever pivotally coupled to a mounting mechanism so that manipulating the lever changes at least the pitch of a string of the stringed musical instrument;

a down stop screw; and an open tuning stop screw, wherein the mounting mechanism includes a flat head screw coupled to a mounting nut so that the string is positioned over the flat head screw and attached to the lever, and wherein the down stop screw limits movement of the lever towards the string to set a maximum tension on the string, and wherein the open tuning stop screw limits movement of the lever away from the string to set a minimum tension on the string.

8. The device of claim 7, further comprising a roller, wherein the roller is coupled to the mounting mechanism and accommodates movement of the string by changes to string tension during engagement of the lever.

9. The device of claim 7, wherein the mounting mechanism is configured to correspond to existing mounting holes of a stringed musical instrument without modification.

10. The device of claim 7, wherein the mounting mechanism is pivotably attached to the stringed musical instrument to permit the pitch changer to move out of the way from a user's hands.

11. The device of claim 7, further comprising a base positioned adjacent to the mounting mechanism and configured to adjust a height of the string relative to the stringed musical instrument.

12. The device of claim 7, wherein the lever includes an outer surface with a texture that allows a user's arm and wrist to push the lever.

13. A pitch changer device installed on a tailpiece of a musical instrument, said pitch changer device comprising:

a knurly arched knob coupled to a mounting mechanism;

a lever pivotally coupled to the mounting mechanism;

a cannulated mounting screw;

a down stop screw; and an open tuning stop screw, wherein the arched knob is coupled to the mounting screw and a string of a stringed musical instrument, and wherein the lever changes at least the pitch of the string of the stringed musical instrument, and wherein the string of the musical instrument is provided through the cannulated screw so that rotating the knurly arched knob and the lever manipulates the pitch of the string by adjusting string tension, and wherein the down stop screw limits movement of the arched knob and the lever towards the string to set a maximum tension on the string, and wherein the open tuning stop screw limits movement of the arched knob and the lever away from the string to set a minimum tension on the string.

14. The device of claim 13, further comprising a roller, wherein the roller is coupled to the mounting mechanism and accommodates movement of the string by changes to string tension during rotation of the arched knob and engagement of the lever.

15. The device of claim 13, wherein the mounting mechanism is configured to correspond to existing mounting holes of a stringed musical instrument without modification.

16. The device of claim 13, wherein the mounting mechanism is pivotably attached to the stringed musical instrument to permit the pitch changer to move out of the way from a user's hands.

17. The device of claim 13, further comprising a base positioned adjacent to the mounting mechanism and configured to adjust a height of the string relative to the stringed musical instrument.

18. The device of claim 13, wherein the arched knob and the lever includes an outer surface with a texture that allows a user's arm and wrist to turn the arched knob.

19. The device of claim 13, wherein the arched knob works independently of the lever in manipulating the pitch of the string.

20. The device of claim 13, further comprising a plurality of arched knobs and levers to provide a customizable pitch changer for a user.

* * * * *